US009841256B2

(12) United States Patent
Teetzel et al.

(10) Patent No.: US 9,841,256 B2
(45) Date of Patent: Dec. 12, 2017

(54) COMBINED LAUNCH AND STORAGE TUBE FOR MISSILE

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 15/403,717

(22) Filed: Jan. 11, 2017

(65) Prior Publication Data

US 2017/0205193 A1 Jul. 20, 2017

Related U.S. Application Data

(60) Provisional application No. 62/279,808, filed on Jan. 17, 2016.

(51) Int. Cl.
*F41F 3/042* (2006.01)
*F41F 3/077* (2006.01)

(52) U.S. Cl.
CPC ..... *F41F 3/042* (2013.01); *F41F 3/077* (2013.01)

(58) Field of Classification Search
CPC ..... F41F 3/042; F41F 3/077
USPC ..... 89/1.801, 1.815, 1.817, 1.819
See application file for complete search history.

(56) References Cited

U.S. PATENT DOCUMENTS 2,972,933 A 2/1961 Guthrie et al.
3,182,553 A 5/1965 Choate et al.
3,398,640 A * 8/1968 Apotheloz ..... F41A 19/29 42/105
3,750,529 A * 8/1973 Reed ..... F41F 3/0455 89/1.8
3,988,961 A * 11/1976 Banta ..... F41F 3/042 89/1.807
4,336,740 A * 6/1982 Leigh ..... F41F 3/052 89/1.806

(Continued)

FOREIGN PATENT DOCUMENTS

WO 2017123904 A1 7/2017

OTHER PUBLICATIONS

International Search Report for PCT/US2017/013379 dated Apr. 4, 2017.

*Primary Examiner* — Bret Hayes
(74) *Attorney, Agent, or Firm* — McLane Middleton, Professional Association

(57) ABSTRACT

A dual purpose missile storage and launch tube device includes a tubular housing and a front cover removably covering a first end of the tubular housing, the first end defining an opening for firing a missile. A rear cover assembly removably covers a second end of the tubular housing opposite the first end. A safety mechanism is attached to the tubular housing and includes a sliding member extending through a longitudinal passageway formed in the safety mechanism. A forward portion of the sliding member engages the front cover. A rearward portion of the sliding member engages a fastener locking the rear cover assembly onto the tubular housing. The rearward portion of the sliding member is disengaged from the fastener when the front cover is removed from the first end of the tubular housing for unlocking the rear cover assembly from the tubular housing.

18 Claims, 36 Drawing Sheets

(56) References Cited

U.S. PATENT DOCUMENTS

| | | | | |
|---|---|---|---|---|
| 4,531,445 | A * | 7/1985 | Nee | F41F 3/0455 89/1.813 |
| 4,895,061 | A * | 1/1990 | Baricos | F41F 3/0455 89/1.814 |
| 5,239,909 | A * | 8/1993 | Bell | F41F 3/077 89/1.807 |
| 6,290,087 | B1 | 9/2001 | Shacklee | |
| 7,422,102 | B1 * | 9/2008 | Lam | F41F 3/042 206/3 |
| 7,484,449 | B2 | 2/2009 | Shim et al. | |
| 2003/0097951 | A1 | 5/2003 | Kaiserman et al. | |
| 2013/0186263 | A1 * | 7/2013 | Yeh | F41A 21/02 89/1.813 |
| 2016/0054097 | A1 * | 2/2016 | Sylvia | B63G 8/001 124/73 |

* cited by examiner

COMBINED LAUNCH AND STORAGE TUBE FOR MISSILE

CROSS REFERENCE TO RELATED APPLICATION

This application claims the priority benefit of U.S. provisional application no. 62/279,808 filed Jan. 17, 2016. The aforementioned application is incorporated herein by reference in its entirety.

BACKGROUND

The present disclosure relates to a combined storage tube and modular barrel/launch tube for a missile launcher. Barrel-interchangeable projectile weapon systems are known in the art, see, for example, commonly owned U.S. patent application Ser. No. 14/955,363 filed Jun. 2, 2016 (U.S. Patent Application Publication No. US2016/0153744, published Jun. 2, 2016), which employs one or more modular barrel assemblies and one or more modular trigger assemblies which can be attached to a common chassis. The aforementioned publication no. US2016/0153744 is incorporated herein by reference in its entirety.

The present disclosure contemplates a modular barrel assembly which additionally functions as a storage tube for an ammunition round to be fired. The device has covers removably attached to each end of a tubular housing. The device also has a safety mechanism in which the rear cover is locked into place until the front cover is removed. This prevents the barrel assembly from being attached to a weapon in an in-battery condition before the front cover is removed from the exit end of the barrel tube.

SUMMARY

In one aspect, a dual purpose missile storage and launch tube device includes a tubular housing and a front cover removably covering a first end of the tubular housing, the first end defining an opening for firing a missile. A rear cover assembly removably covers a second end of the tubular housing opposite the first end. A safety mechanism is attached to the tubular housing and includes a sliding member extending through a longitudinal passageway formed in the safety mechanism. A forward portion of the sliding member engages the front cover and a rearward portion of the sliding member engages a fastener locking the rear cover assembly onto the tubular housing when the front cover is attached to the first end of the tubular housing. The rearward portion of the sliding member is disengaged from the fastener when the front cover is removed from the first end of the tubular housing for unlocking the rear cover assembly from the tubular housing.

In certain embodiments, a spring member is disposed within the longitudinal passageway urging the sliding member toward the front cover.

In certain embodiments, the front cover includes a closure wall and an annular lip that extends from the closure wall axially toward the second end, the annular lip having a threaded surface which mates with a complementary threaded surface on the first end for securing the front cover over the opening for firing a missile. The annular lip has an edge which bears against the forward portion of the sliding member. The threaded surface and the complementary threaded surface are movable into mating engagement with each other by threading upon relative rotation between the front cover and the tubular housing. The rearward portion of the sliding member is moved into engagement with the fastener upon axial movement of the front cover over the first end of the tubular housing.

In certain embodiments, the device further includes an elastic disk disposed over the opening for firing a missile, the elastic disk having a plurality of slits defining a plurality of flaps.

In certain embodiments, the device further includes a missile received within the tubular housing.

In certain embodiments, the device further includes one or more indicia for visually indicating whether a missile contained within the tubular housing is safe to fire.

In certain embodiments, the indicia includes a first indicia which is visible through a window in a wall defining the longitudinal passageway when the front cover is removed from the first end and which is not visible through the window when the front cover is attached to the first end.

In certain embodiments, the fastener includes a latch on the rear cover assembly removably engaging a catch on the safety mechanism.

In certain embodiments, the device further includes a weapon interface attached to the tubular housing for removably attaching the device to a missile firing platform.

In certain embodiments, the rear cover assembly is configured to cover the weapon interface when the rear cover assembly is covering the second end of the tubular housing.

In certain embodiments, a second fastener removably secures the rear cover assembly to the weapon interface.

In certain embodiments, a second fastener removably secures the rear cover assembly to the tubular housing.

In certain embodiments, the device further includes a fastener for securing the device to an article having a plurality of loops of webbing material, the fastener comprising a first tongue attached to the rear cover assembly and a second tongue carried on a sliding member attached to the tubular hosing, the sliding member movable toward and away from the first tongue to selectively engage and disengage the plurality of loops of webbing material.

In a further aspect, a method is provided for assembling a dual purpose missile storage and launch tube device, wherein the device comprises (a) a tubular housing; (b) a front cover configured to removably cover a first end of the tubular housing, the first end defining an opening for firing a missile; (c) a rear cover assembly configured to removably cover a second end of the tubular housing, the second end opposite the first end; and (d) a safety mechanism attached to the tubular housing, the safety mechanism including a sliding member extending through a longitudinal passageway formed in the safety mechanism. The method includes attaching the rear cover to the second end of the tubular housing and moving the sliding member into engagement with a fastener on the rear cover assembly by attaching the front cover to the first end of the tubular housing, the sliding member and the fastener cooperating to lock the rear cover into position over the second end.

In certain embodiments, the force for moving the sliding member is transmitted by the front cover acting directly on the sliding member.

In certain embodiments, the front cover includes a closure wall and an annular lip that extends from the closure wall axially toward the second end. The annular lip has a threaded surface which mates with a complementary threaded surface on the first end and an edge which bears against a forward portion of the sliding member.

In certain embodiments, rotational movement of the front cover with respect to the tubular housing in one direction causes axial sliding movement of the sliding member.

In certain embodiments, the fastener includes a latch on the rear cover assembly which removably engages a catch on the safety mechanism.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT(S)

Figure 1:
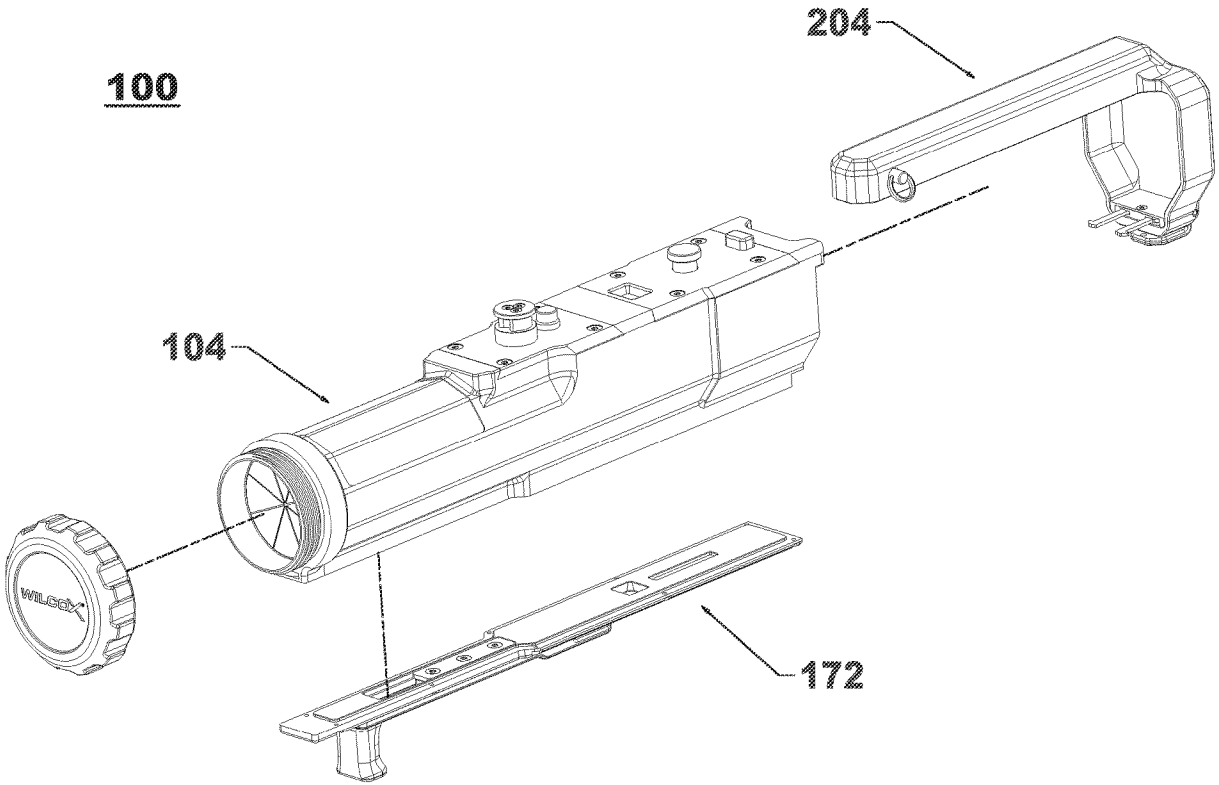
FIG. 1 is a partially exploded view of an exemplary modular missile launcher barrel and storage tube taken generally from the front, right, and above. The terms "up," "down,", "top,", "bottom," "front," "rear," and the like, as used herein, refer to the orientation shown in FIG. 1. The terms "left" and "right" as used herein are in reference to a person facing the front of the unit.
Figure 2:
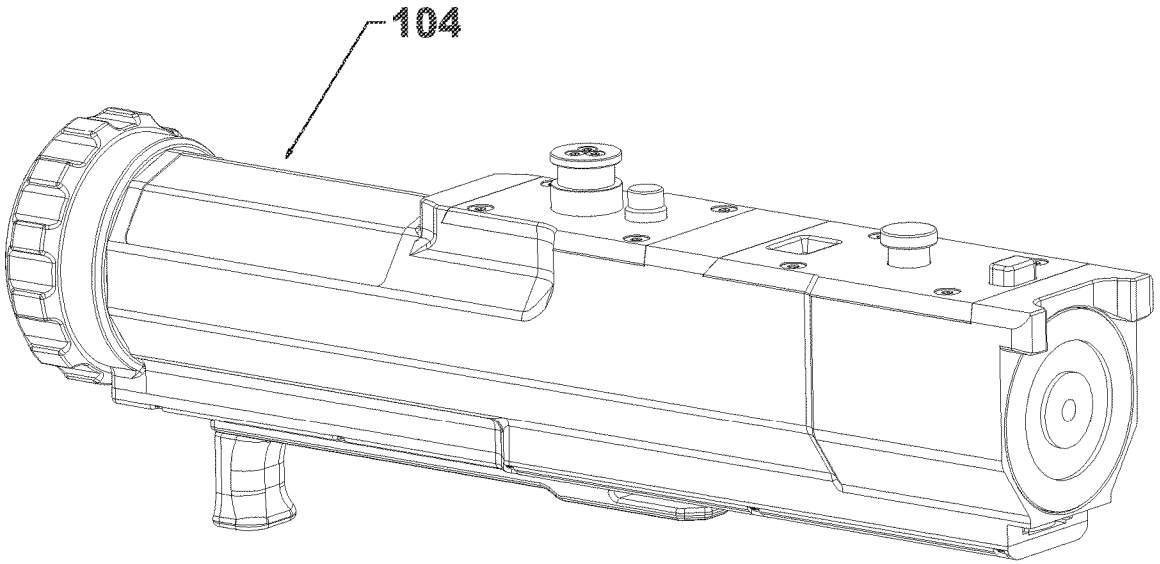
FIG. 2 is an isometric view of the modular missile launcher barrel and storage tube appearing in FIG. 1, taken generally from the rear and right side and having the rear cover removed.
Figure 3:
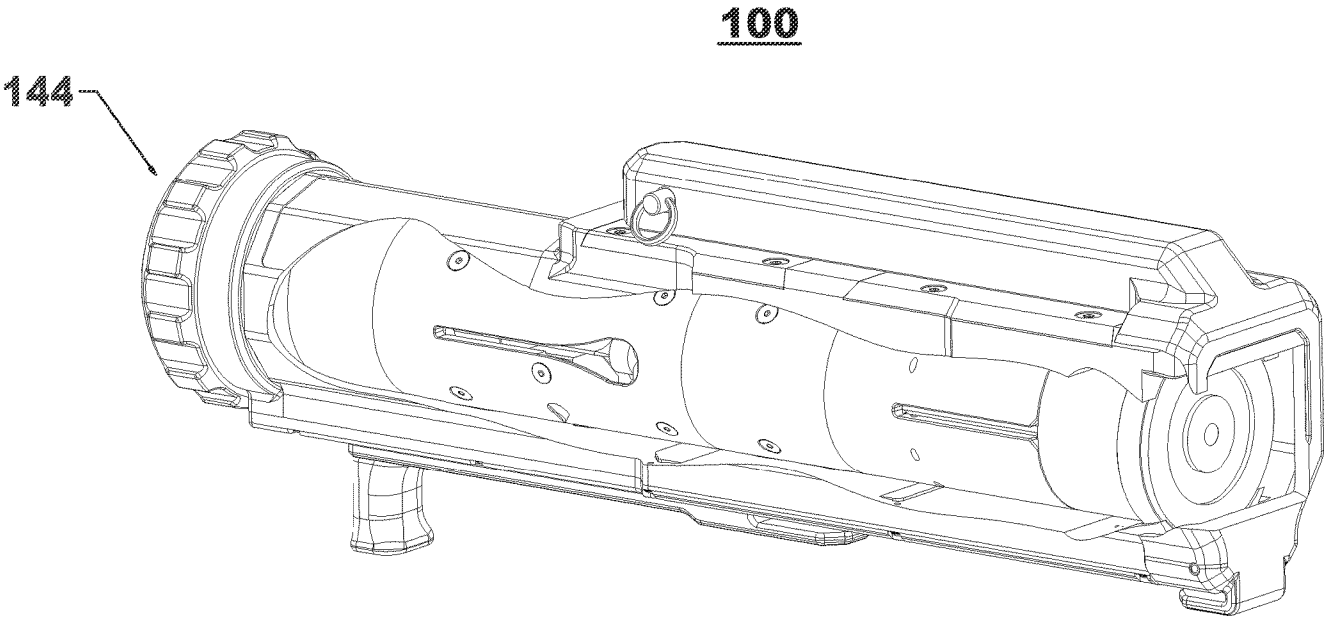
FIG. 3 is an isometric view of the modular missile launcher barrel and storage tube herein, taken generally from the rear and right side and having the rear cover rendered as a translucent object and the main housing rendered as a transparent object.
Figure 4:
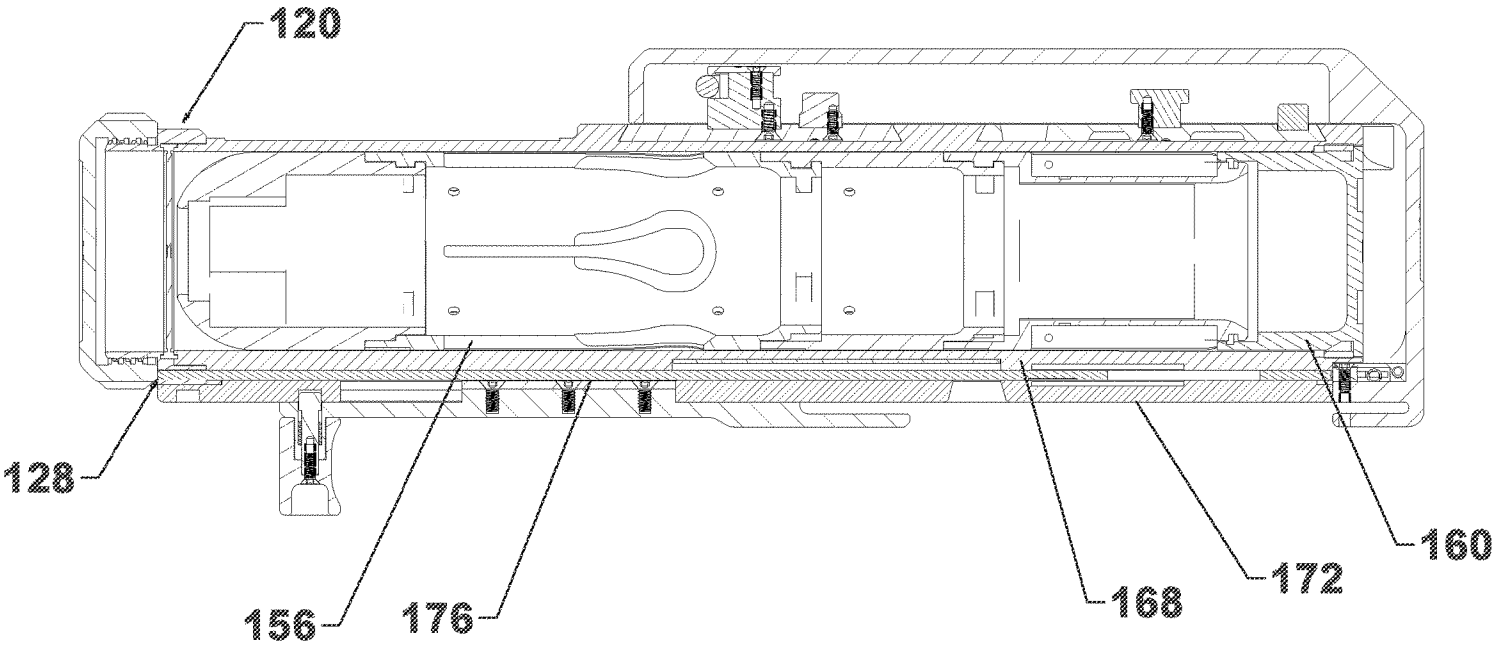
FIG. 4 is an isometric side cross-sectional view taken generally from the rear, right side, and above, with the front and rear covers attached and having a missile stored therein. The missile payload and other internal components are omitted for ease of exposition.
Figure 5:
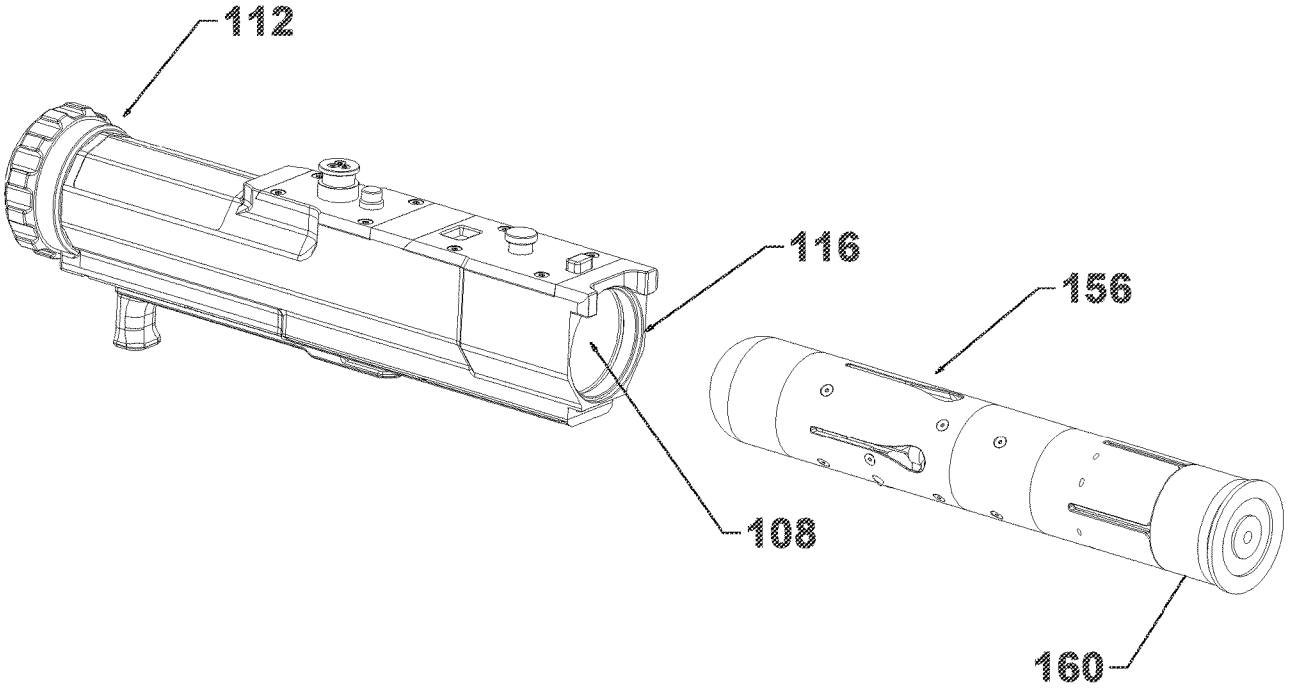
FIG. 5 is a view similar to the view appearing in FIG. 2, illustrating the manner of loading a missile into the unit.
Figure 6:
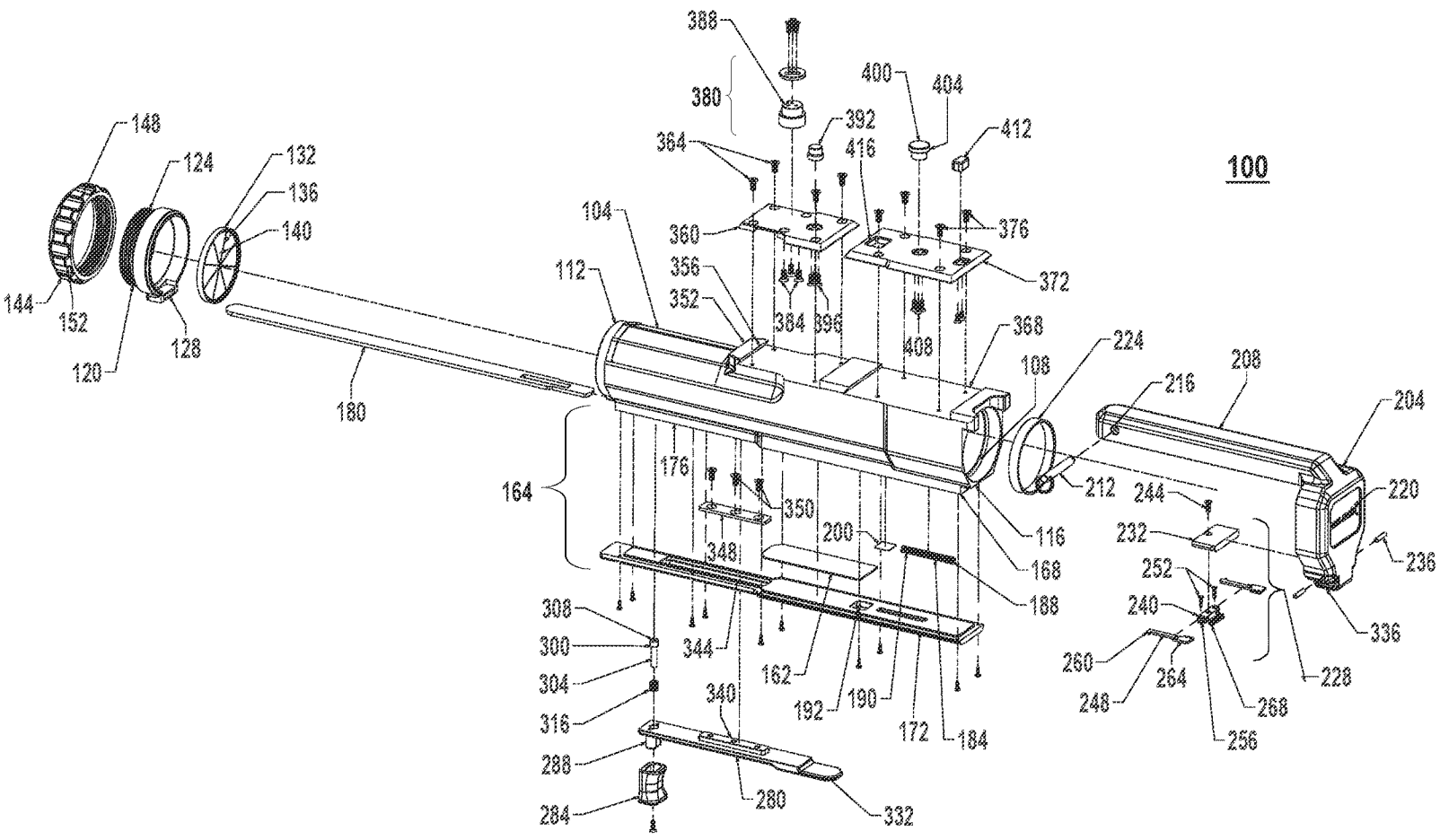
FIG. 6 is an exploded isometric view taken generally from the rear, right, and from above.
Figure 6A:
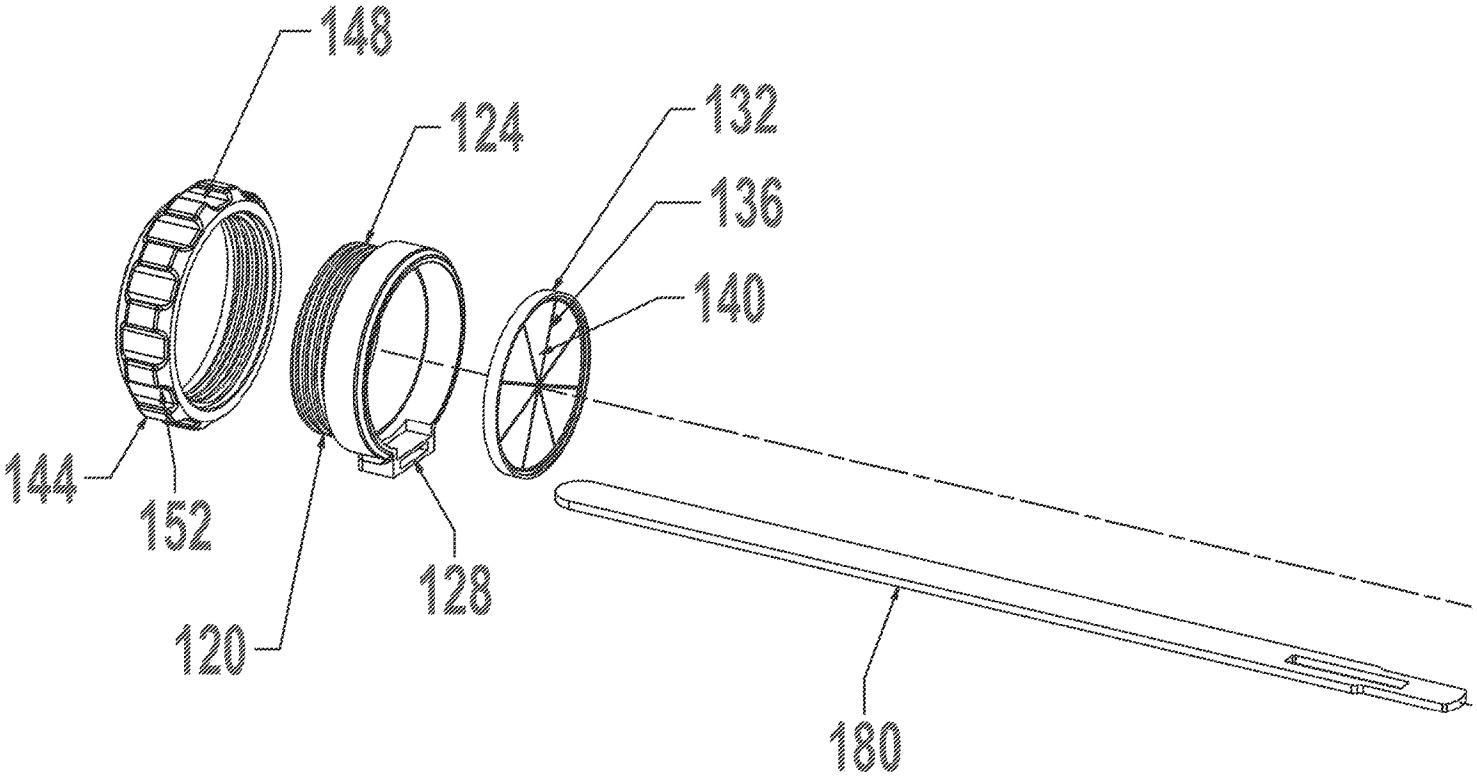
FIG. 6A is an enlarged exploded view of the cover and the tube front end.
Figure 6B:
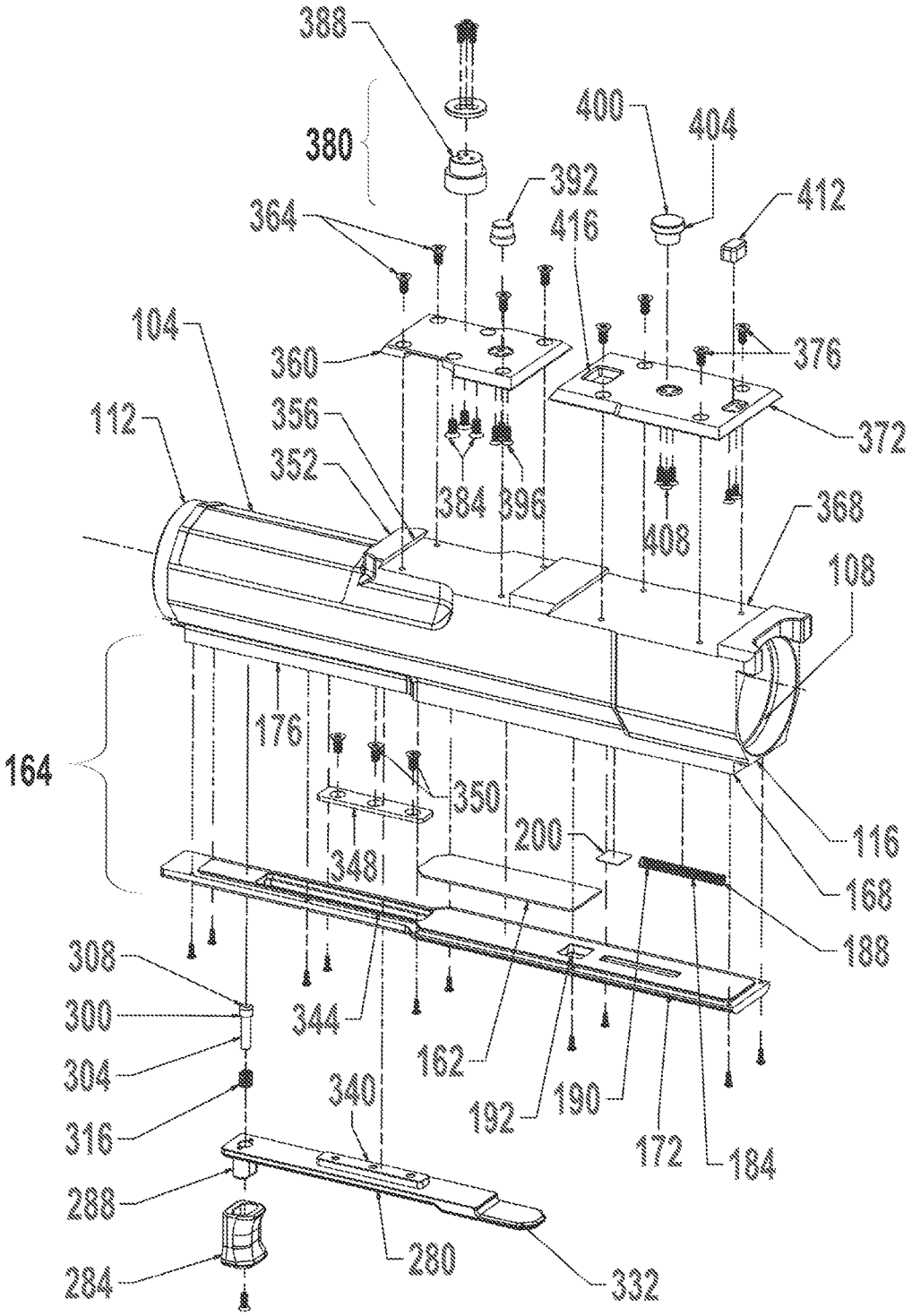
FIG. 6B is an enlarged exploded view of the main tube having the rear cover, front cover, and front threaded finish piece removed.
Figure 6C:
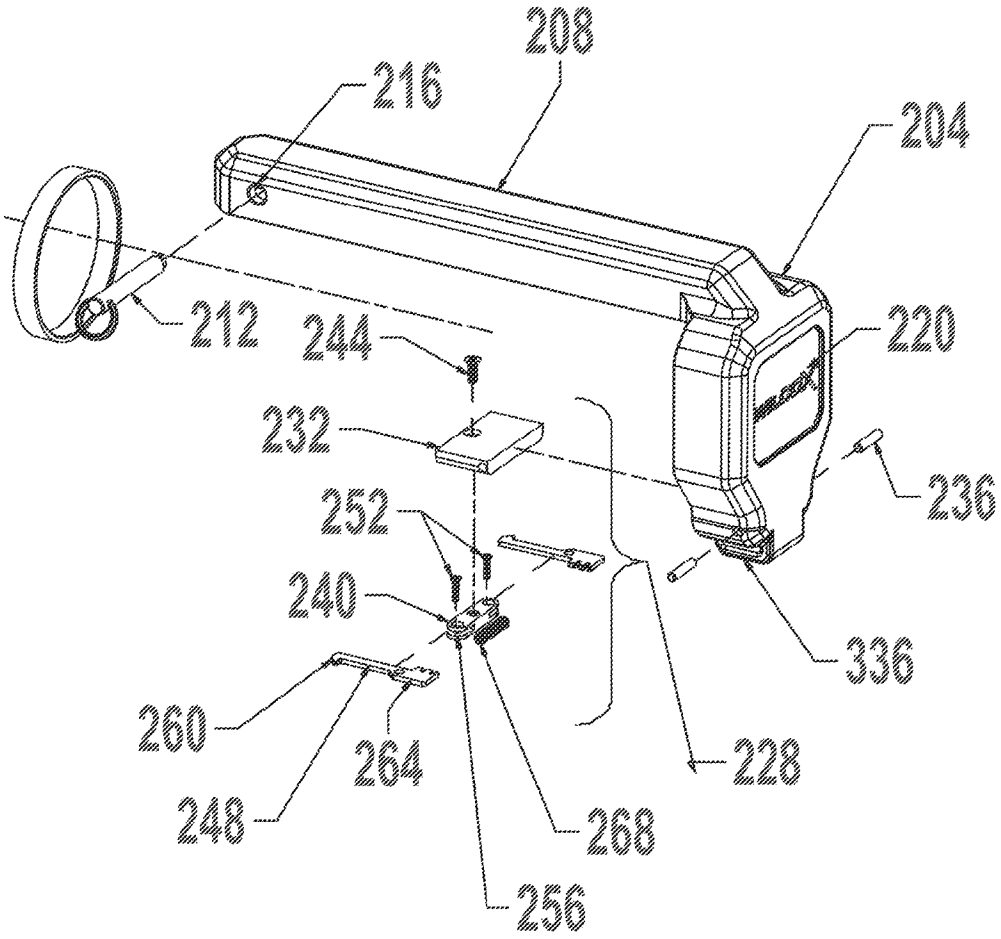
FIG. 6C and 7 are enlarged exploded views of the rear cover and safety assembly.
Figure 7:
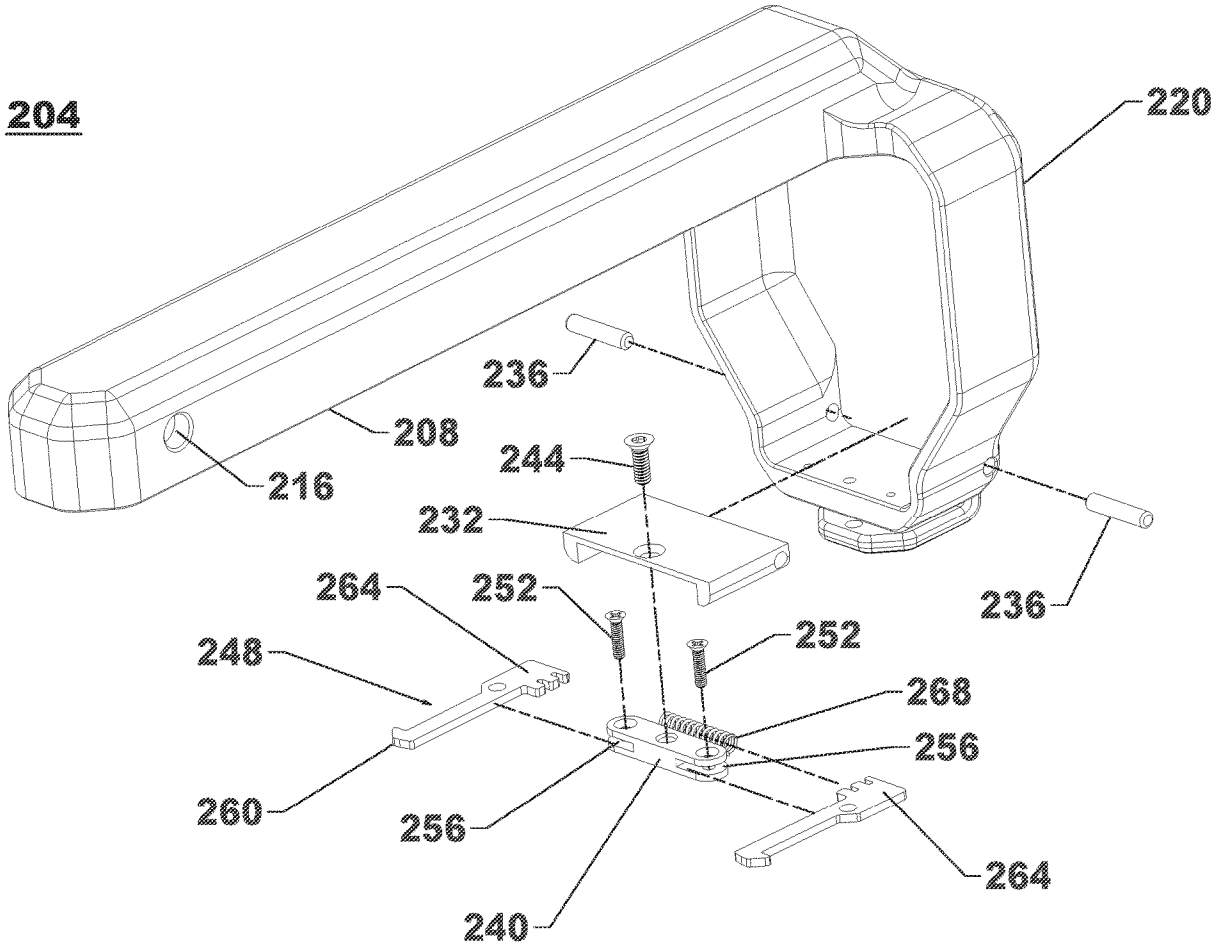
Figure 8:
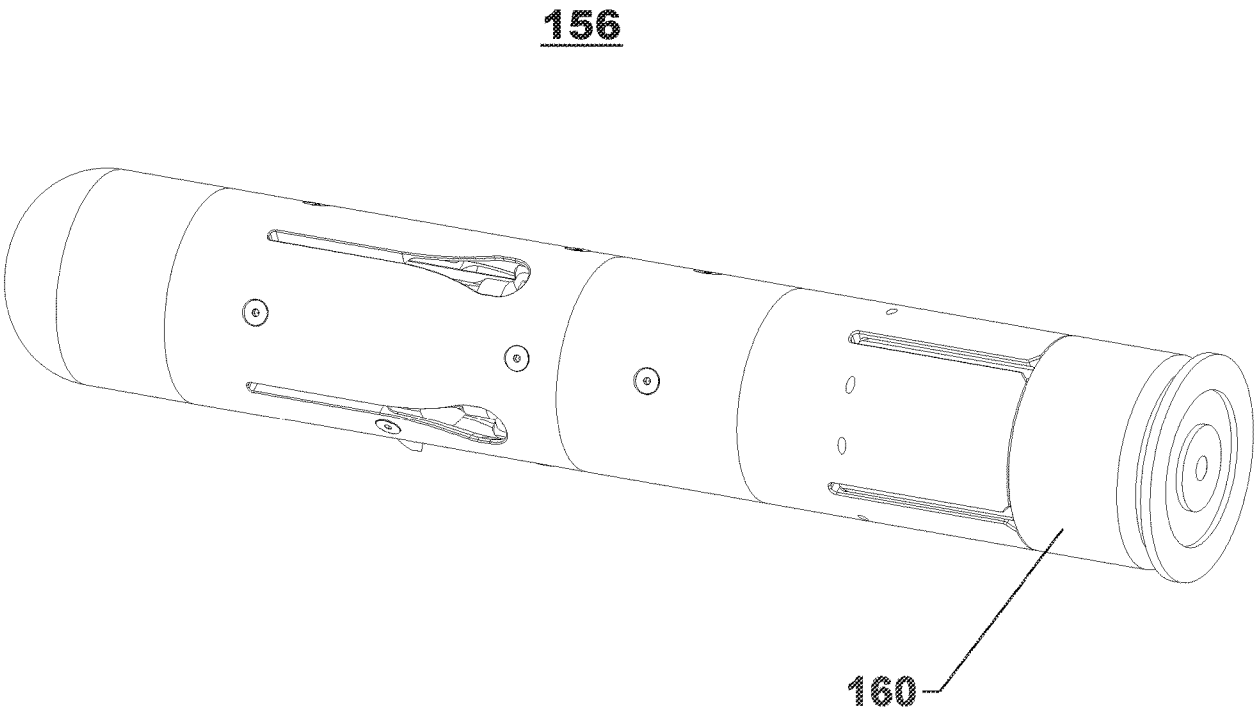
FIG. 8 is an enlarged view of an exemplary missile operable to be launched from and stored in the combined launch/storage tube of the present disclosure.
Figure 9:
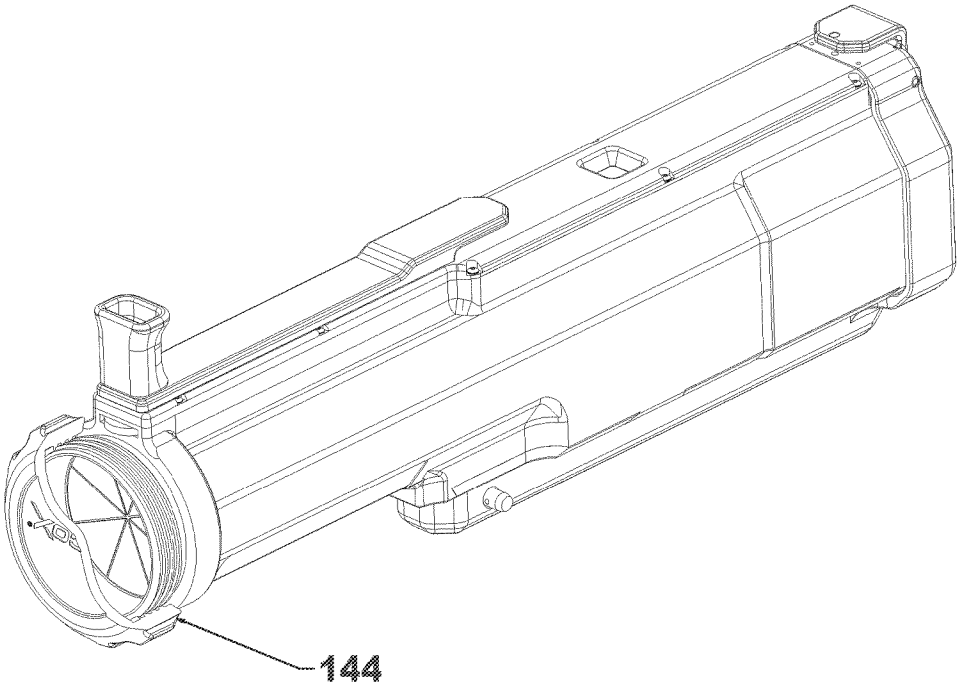
FIG. 9 is an isometric view taken from the bottom and front wherein the front and rear covers are attached.
Figure 10:
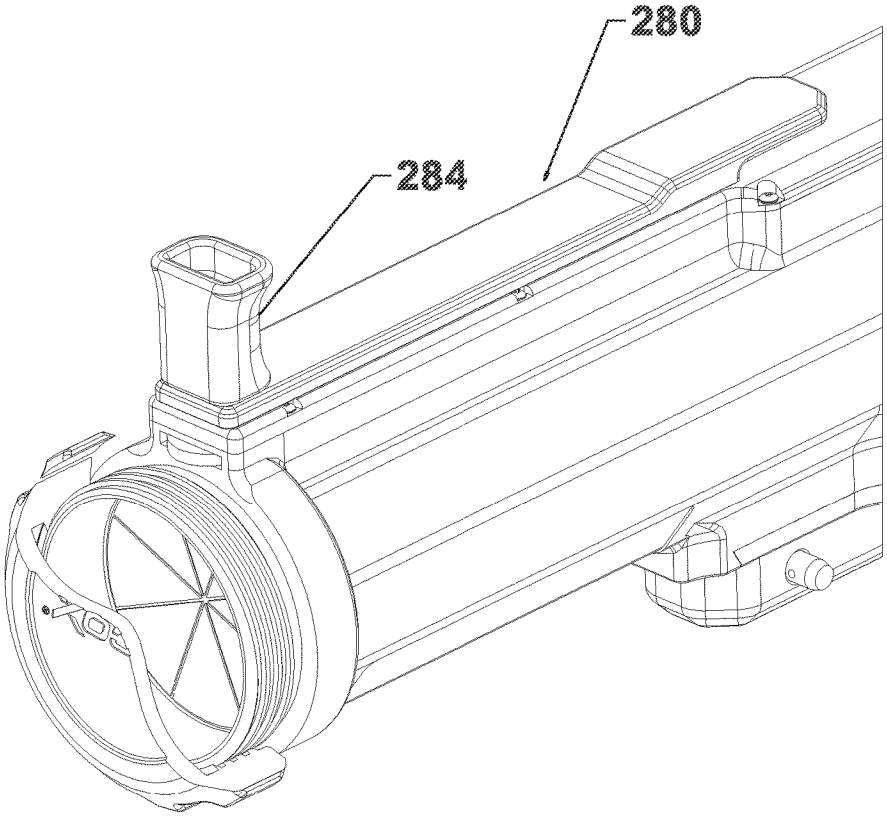
FIGS. 10 and 11 are enlarged, fragmentary isometric view taken from the front and bottom wherein the front cover is rendered as a transparent object illustrating the end of the sliding tongue being retained in the safety position by the rearward edge of the front cover threaded sidewall.
Figure 11:
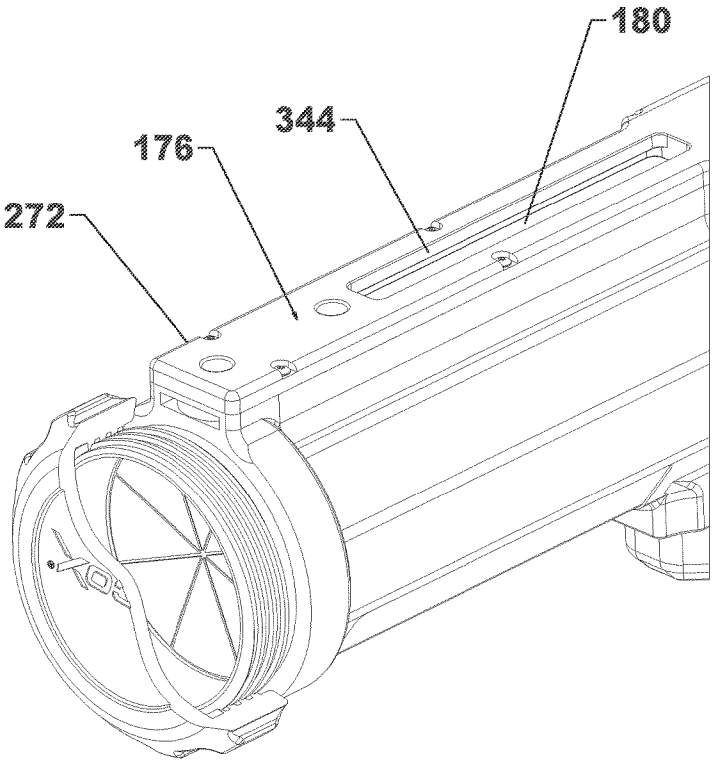
Figure 12:
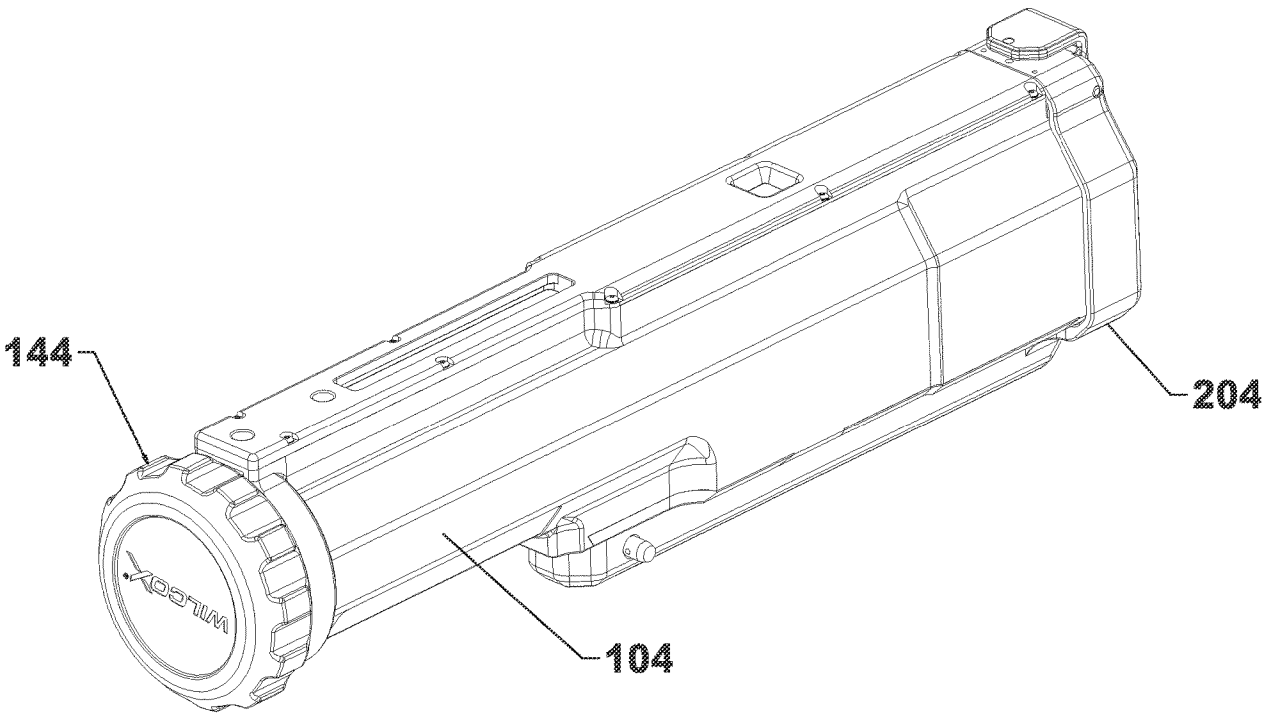
FIG. 12 is an isometric view taken from the bottom and front wherein the front and rear covers are attached and wherein the front cover, rear cover, and the safety housing cover are rendered as transparent objects illustrating the safety mechanism.
Figure 13:
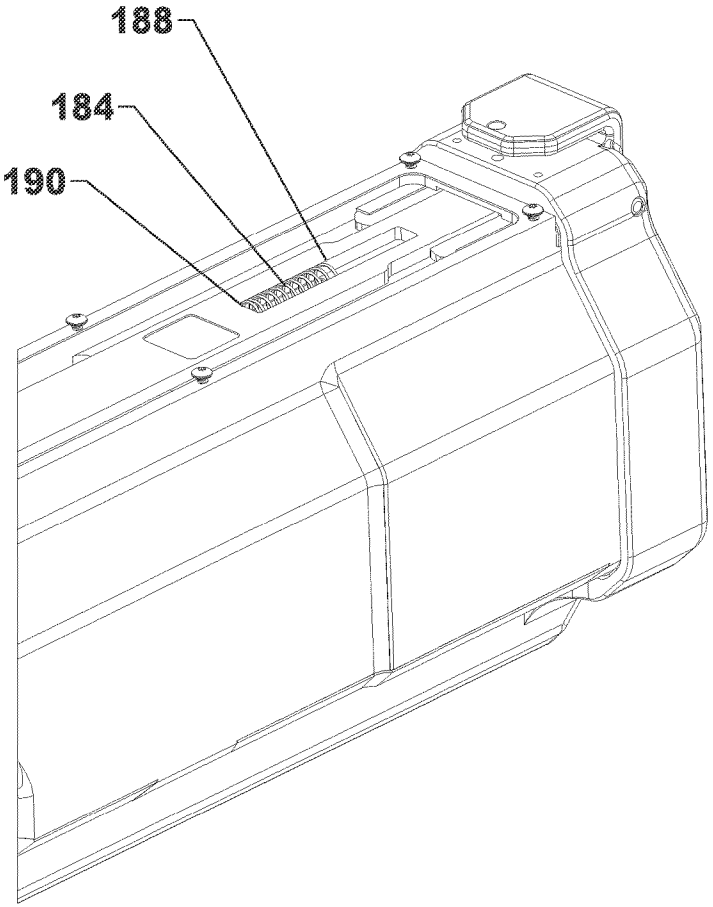
FIGS. 13-17 are enlarged fragmentary views illustrating the rear cover safety mechanism.
Figure 14:
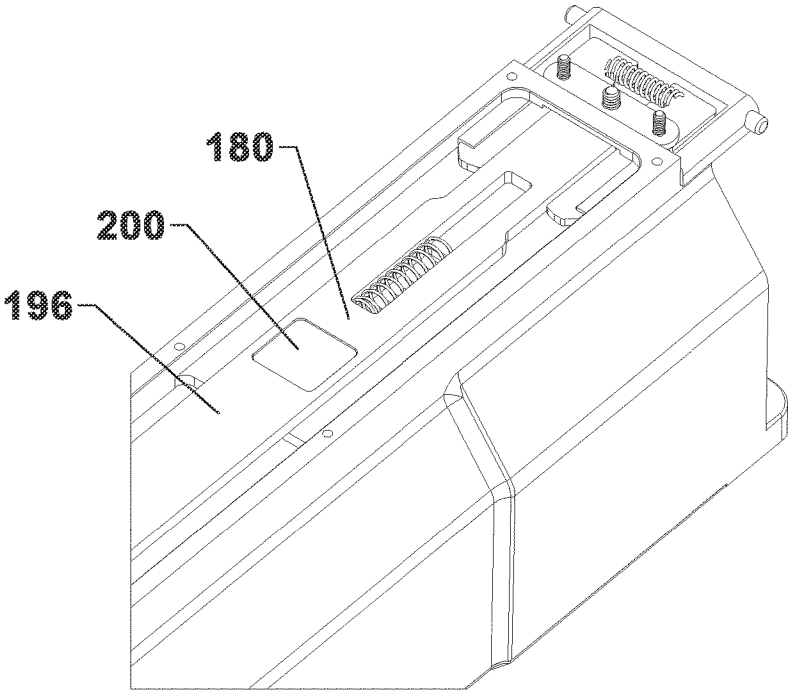
Figure 15:
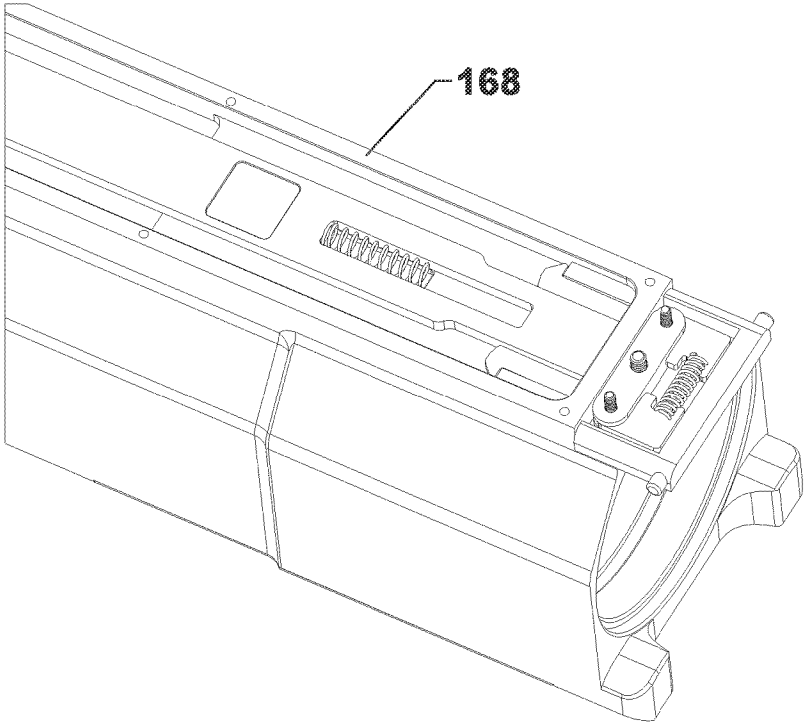
Figure 16:
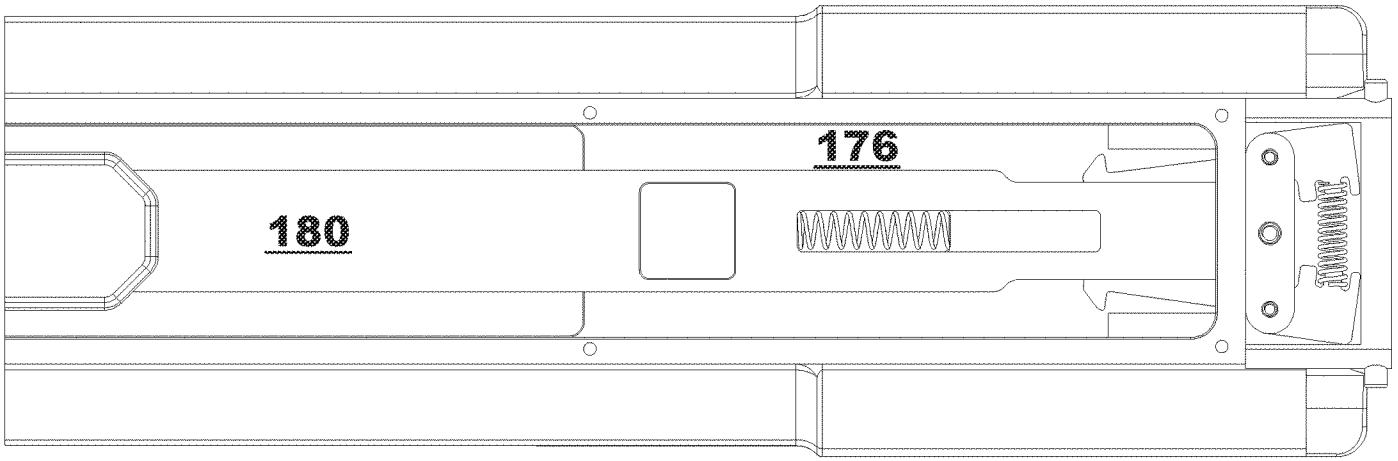
Figure 17:
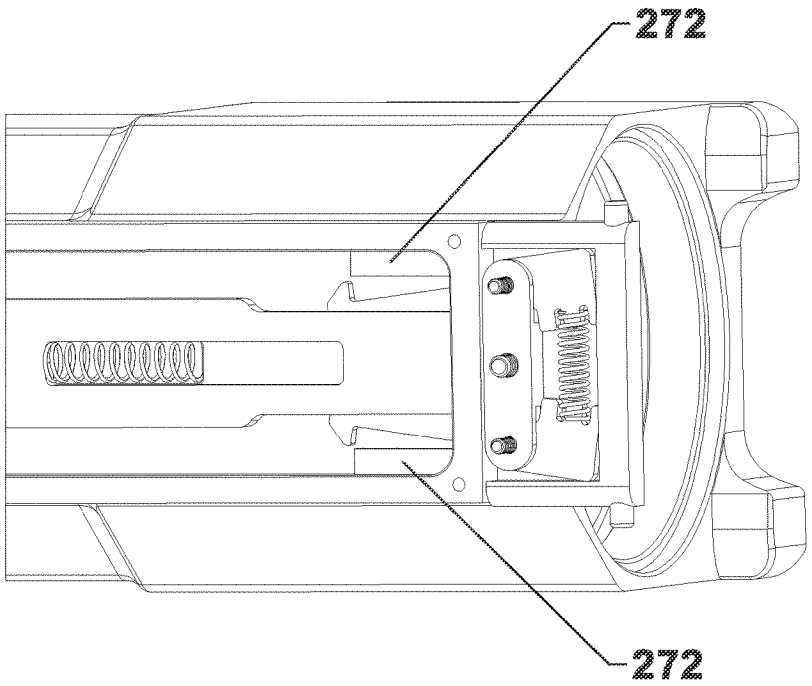
Figure 18:
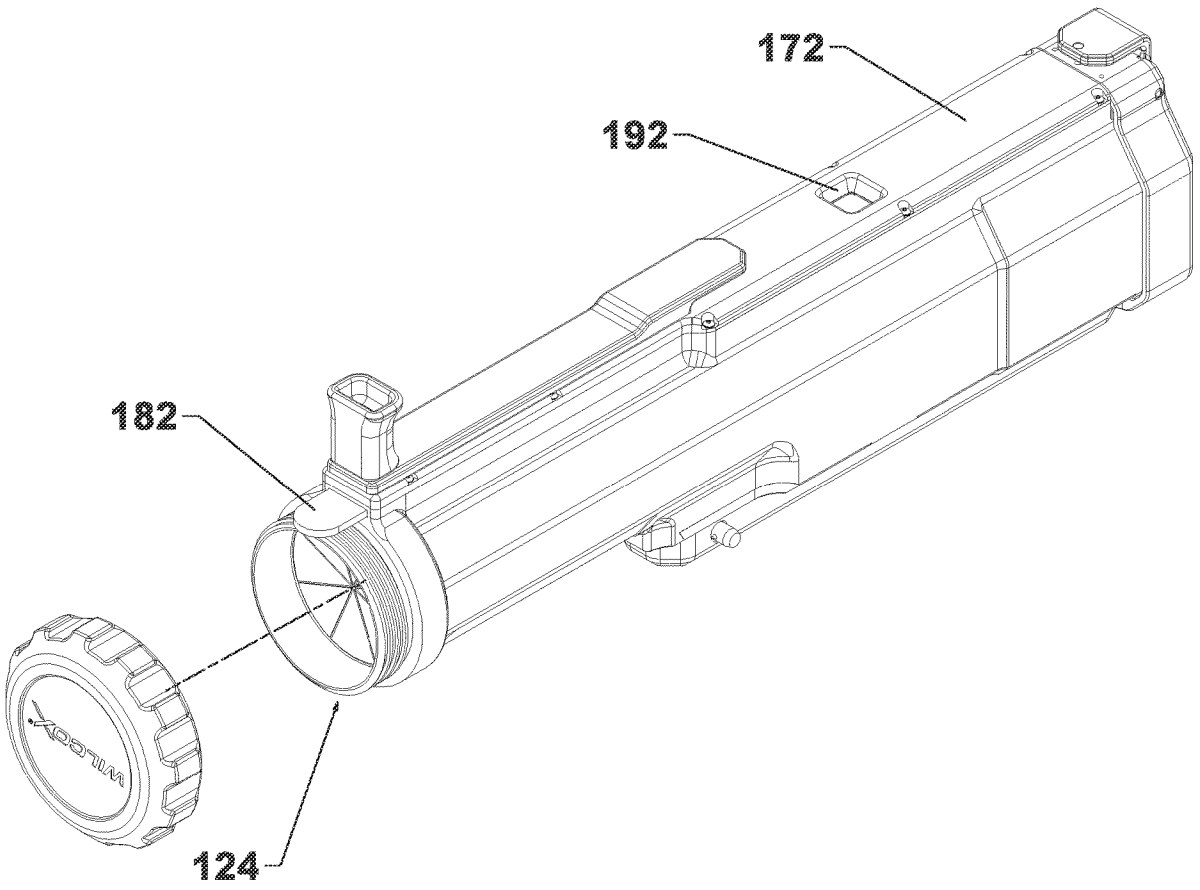
FIG. 18 is an enlarged isometric view taken from below and the front with the cover removed so that the sliding tongue protrudes from the front and the green indicia appears in the window in the safety housing cover, indicating that the safety is disengaged.
Figure 19:
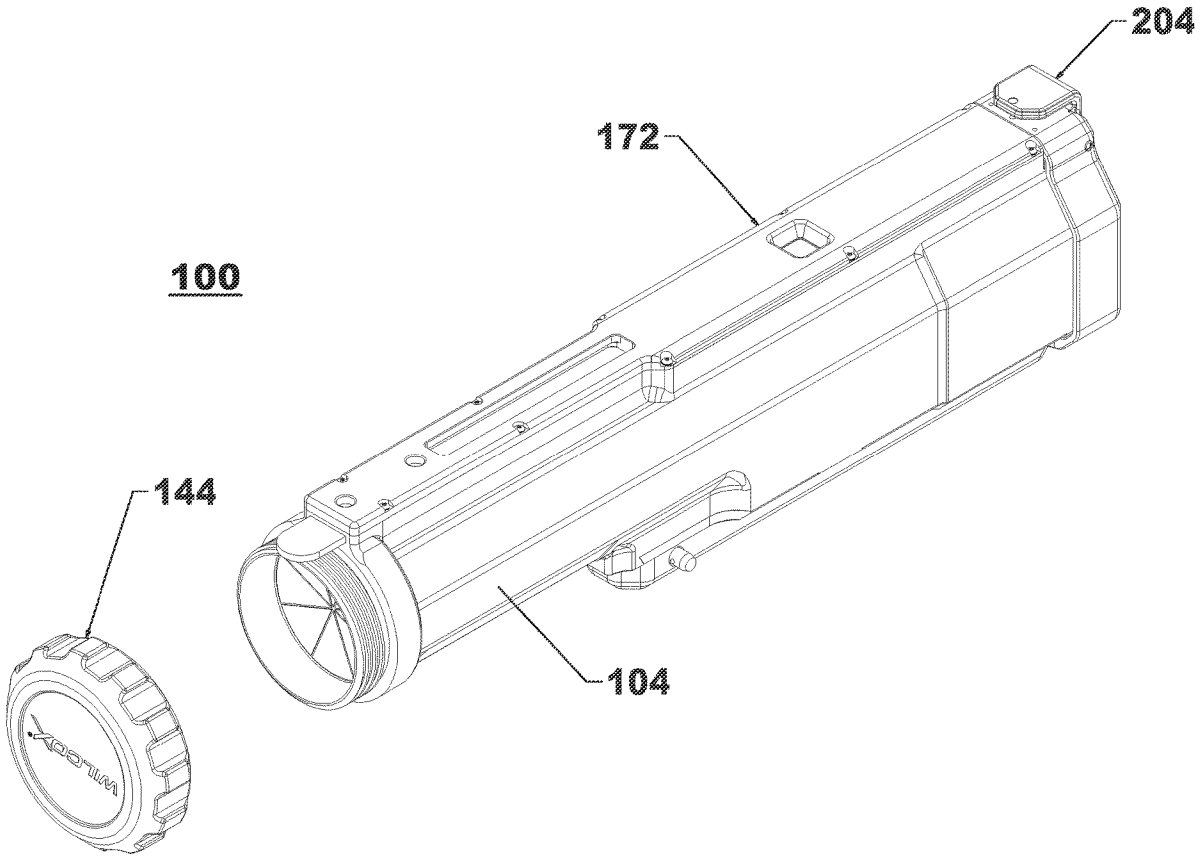
FIGS. 19 and 20 are an enlarged isometric view similar to the view in FIG. 18, wherein the rear cover and safety housing cover are rendered as transparent objects.
Figure 20:
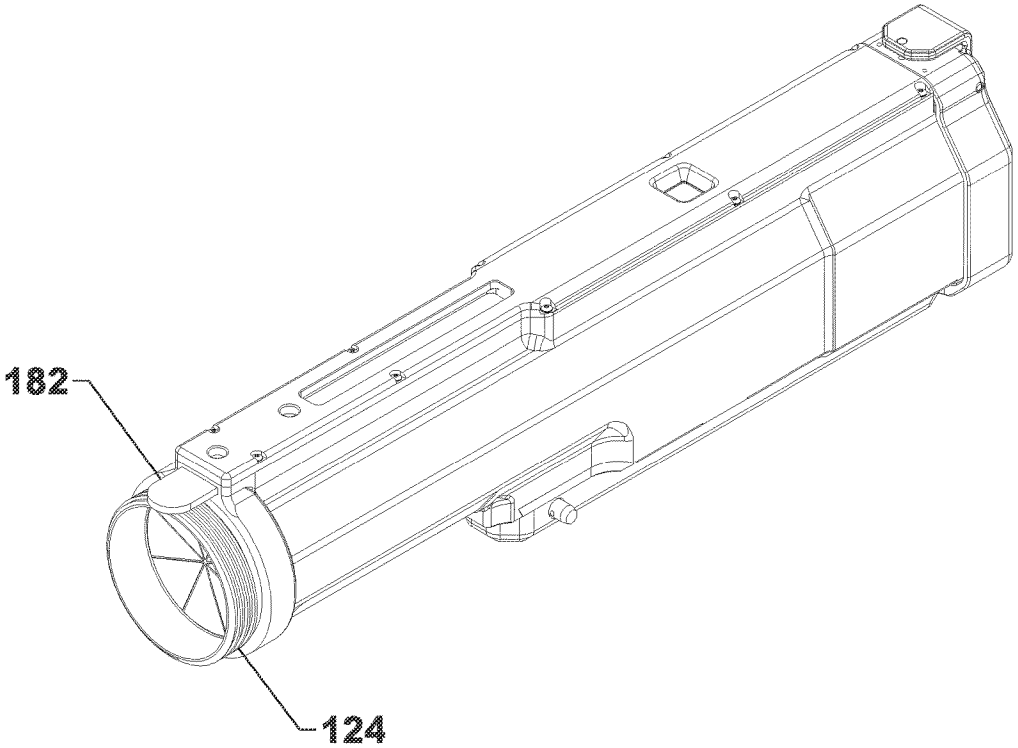
Figure 21:
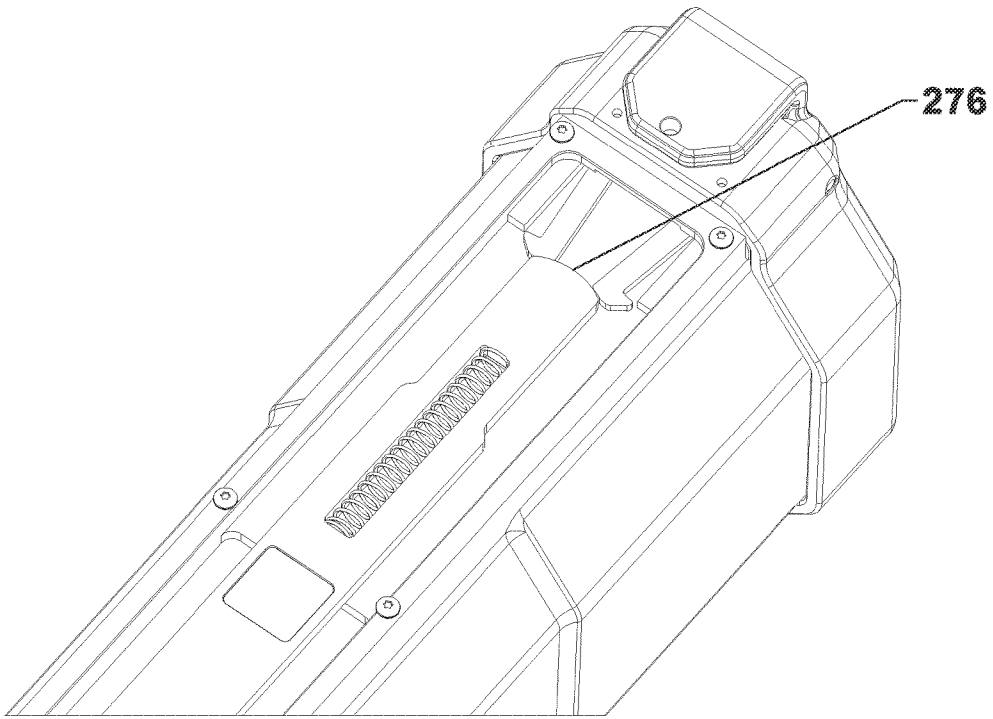
FIG. 21 is an enlarged, fragmentary isometric view with the rear cover and safety housing cover rendered as transparent objects, illustrating the rear safety mechanism.
Figure 22:
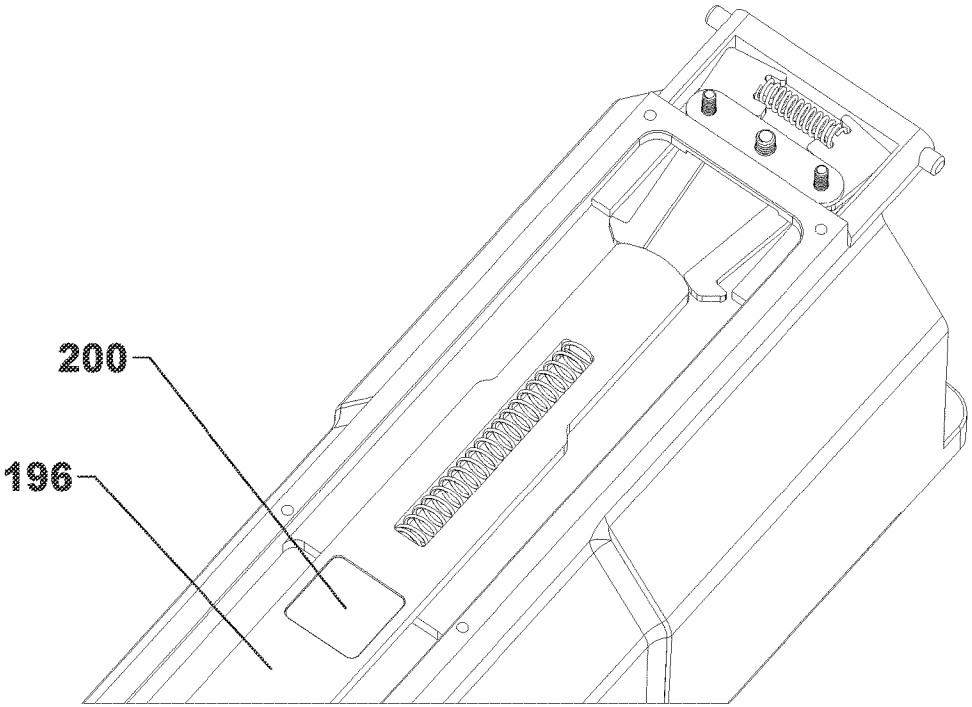
FIG. 22 is an enlarged, fragmentary isometric view with the rear cover and safety housing cover removed, taken from the bottom and front.
Figure 23:
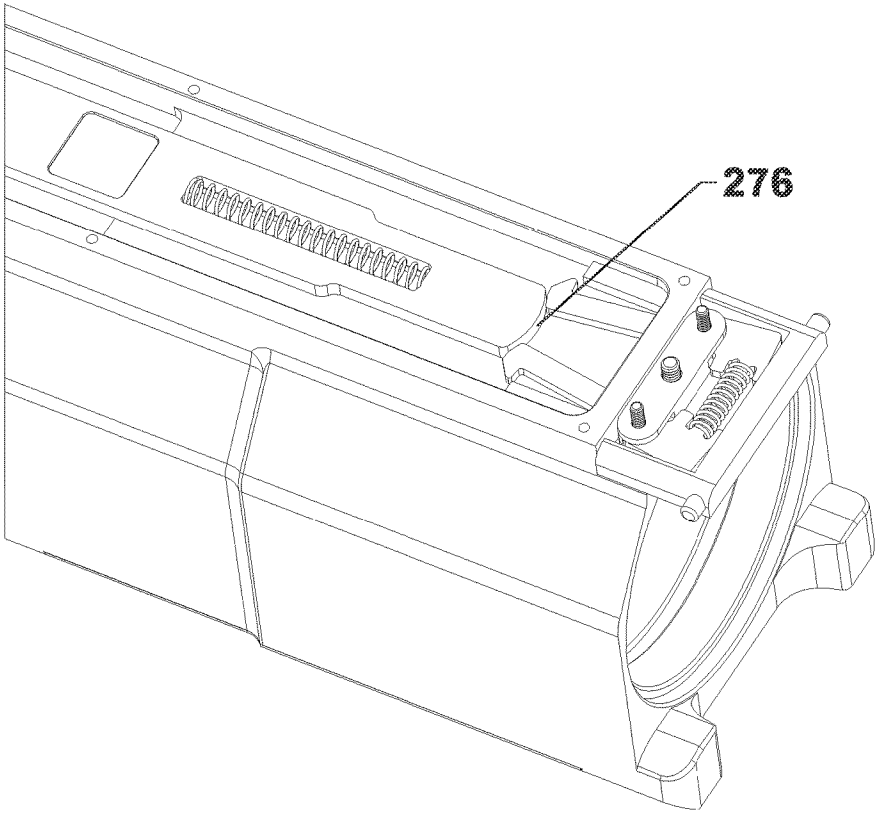
FIG. 23 is an isometric view similar to the view appearing in FIG. 22, taken from the bottom and rear.
Figure 24:
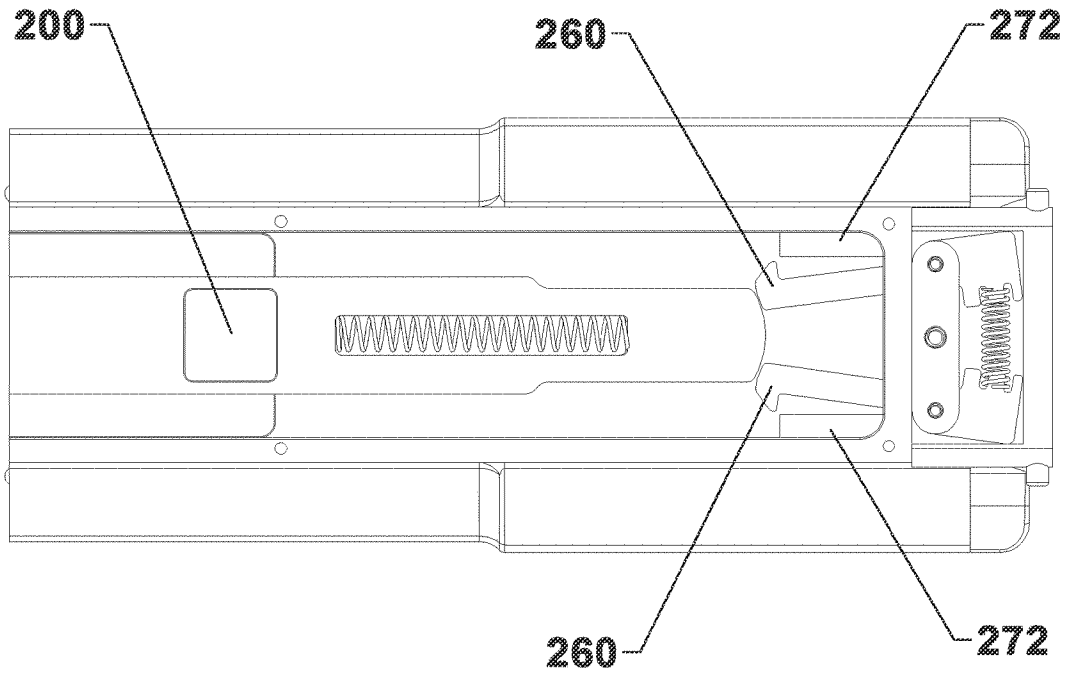
FIGS. 24-26 are a fragmentary, bottom plan views with the rear cover and safety housing cover removed, illustrating the rear safety mechanism.
Figure 25:
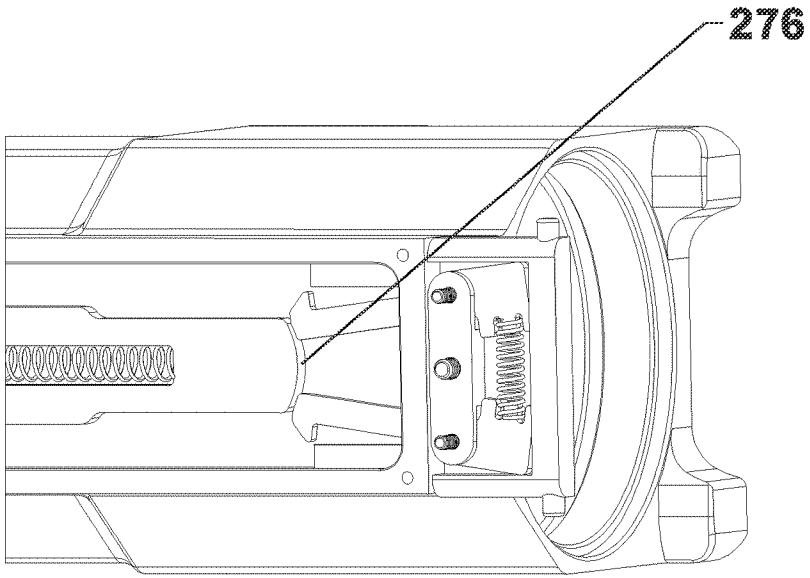
Figure 26:
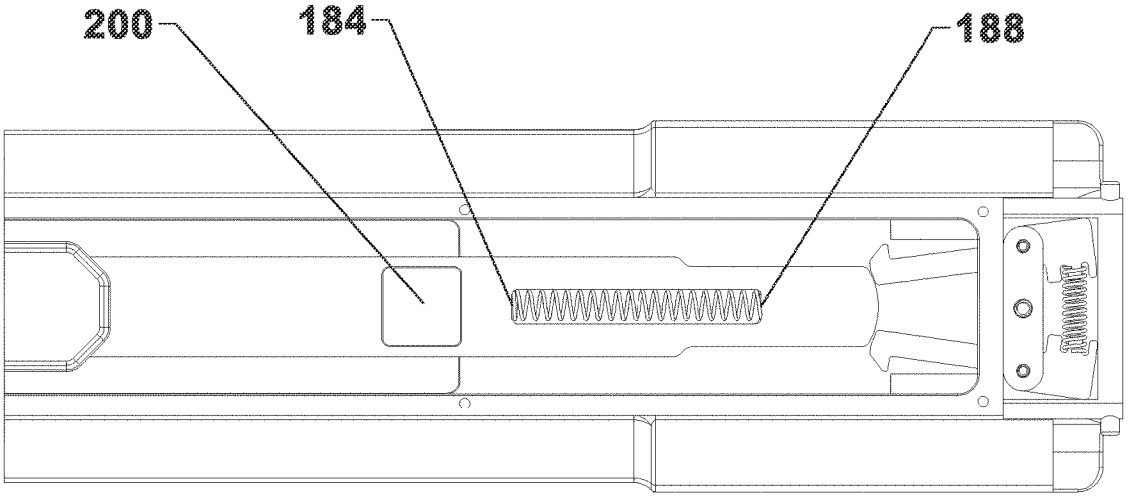
Figure 27:
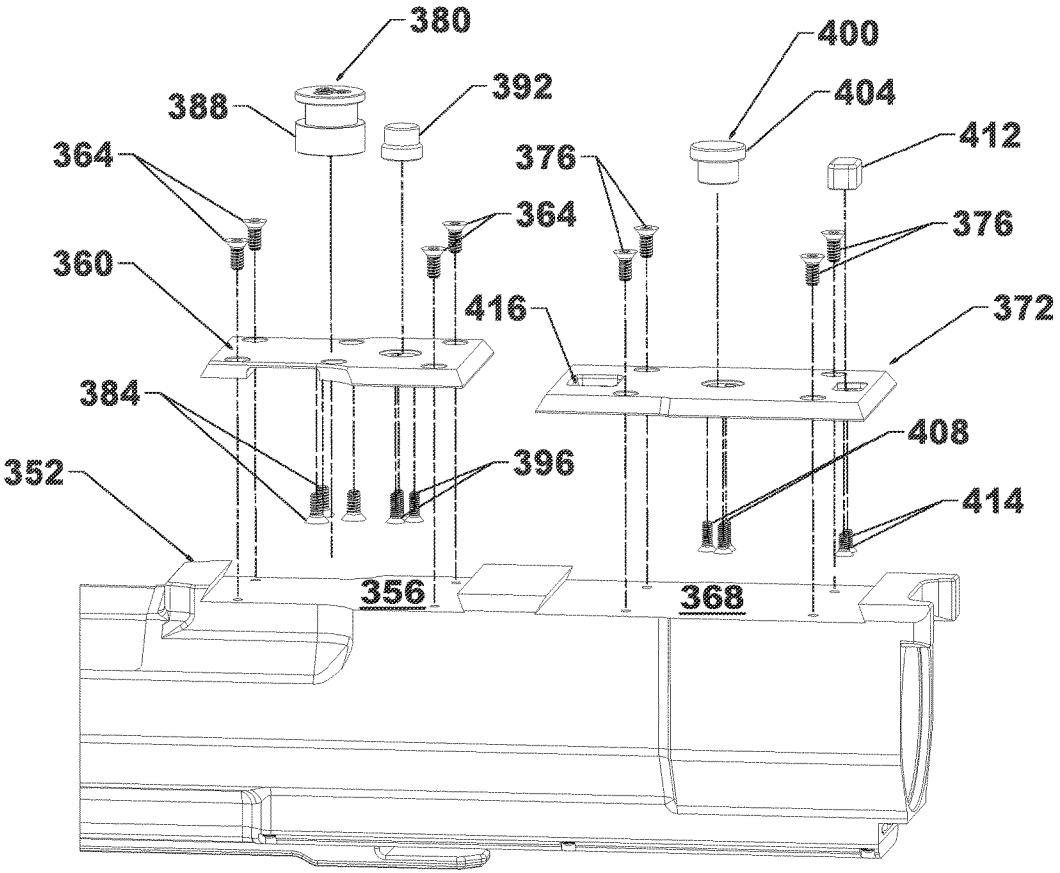
FIG. 27 is an enlarged, isometric, exploded view of the weapon interface for attaching the launch tube herein to a firing platform.
Figure 28:
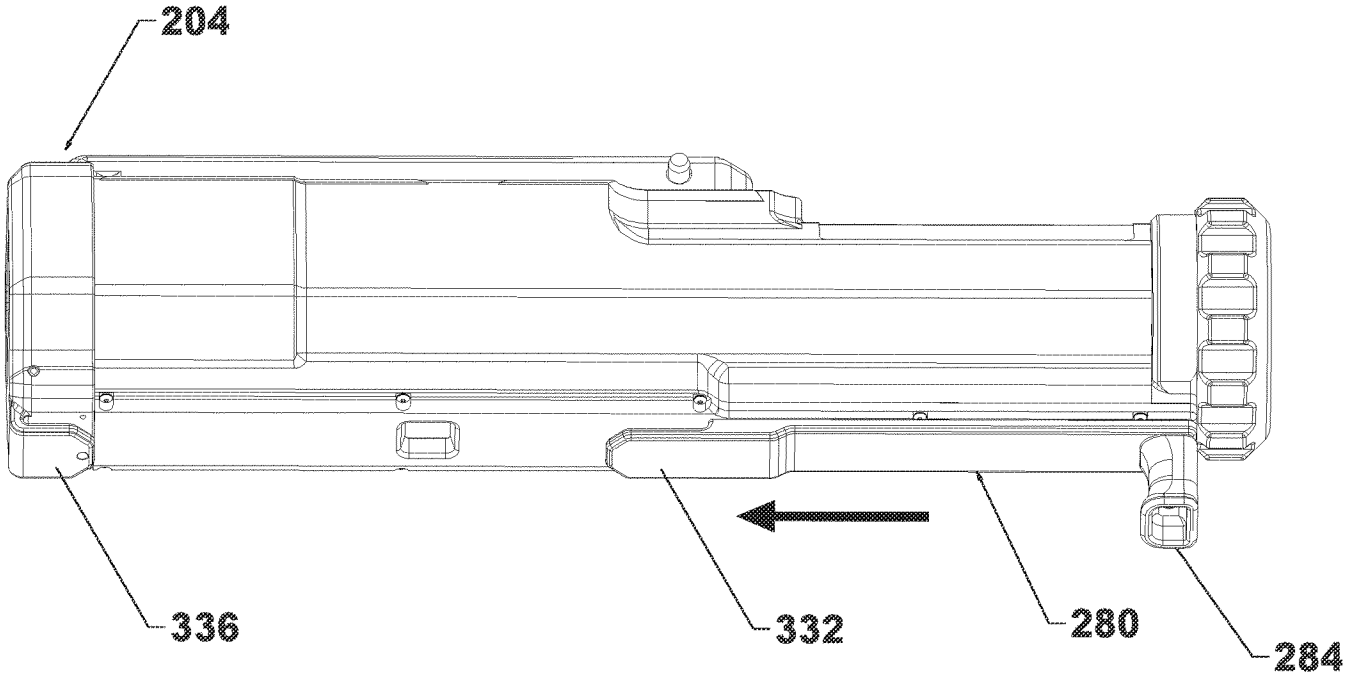
FIGS. 28 and 29 are side/bottom views depicting the MOLLE latch assembly in open and closed configurations, respectively.
Figure 29:
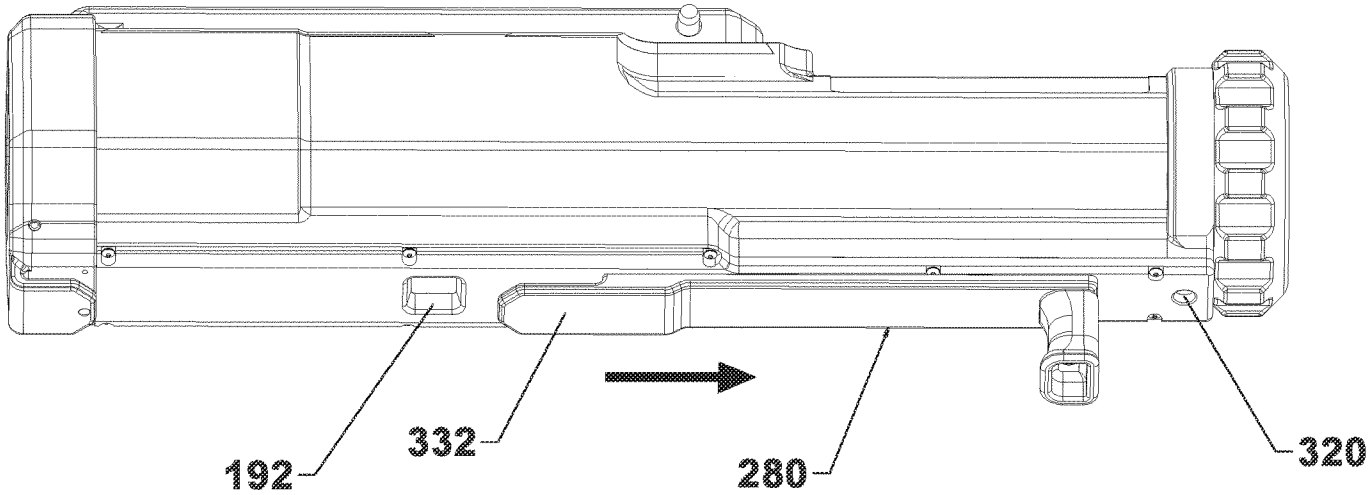
Figure 30:
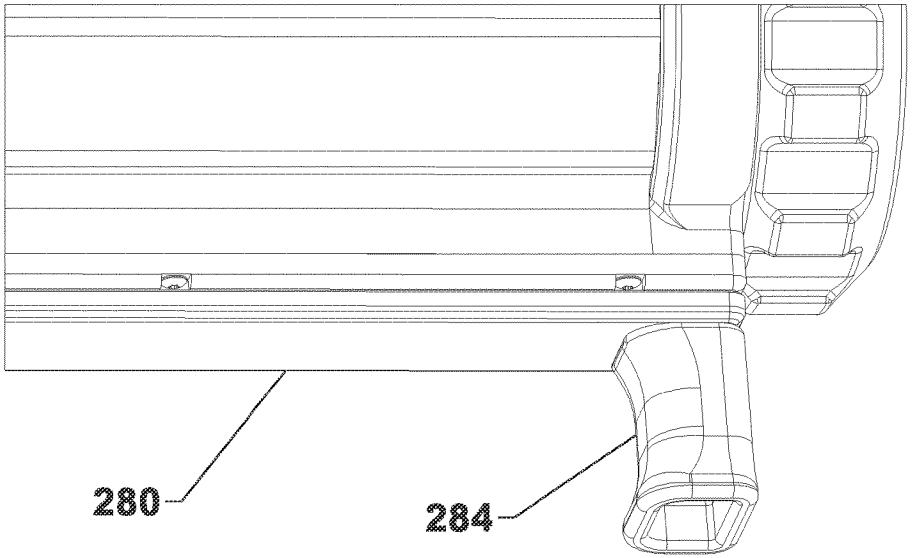
FIG. 30 is an enlarged, fragmentary bottom/side view of the latch assembly wherein the handle and the sliding fastener plate are rendered as translucent objects.
Figure 31:
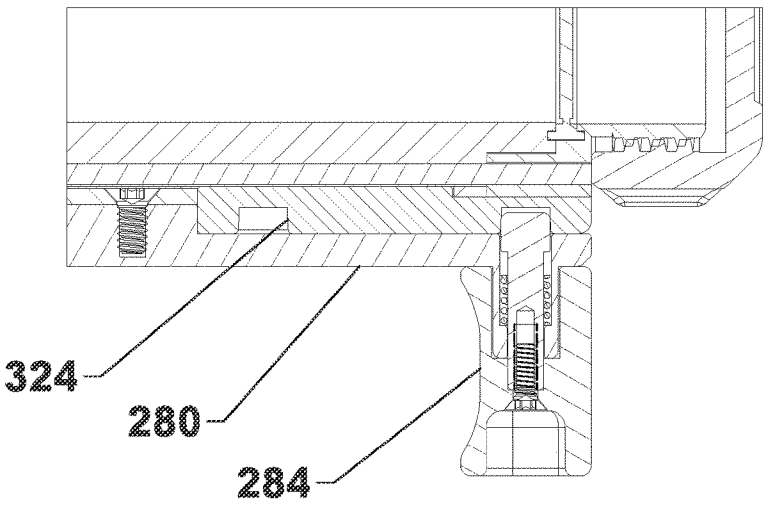
FIGS. 31-33 are enlarged, fragmentary side cross-sectional views of the latch release mechanism for the latch assembly.
Figure 32:
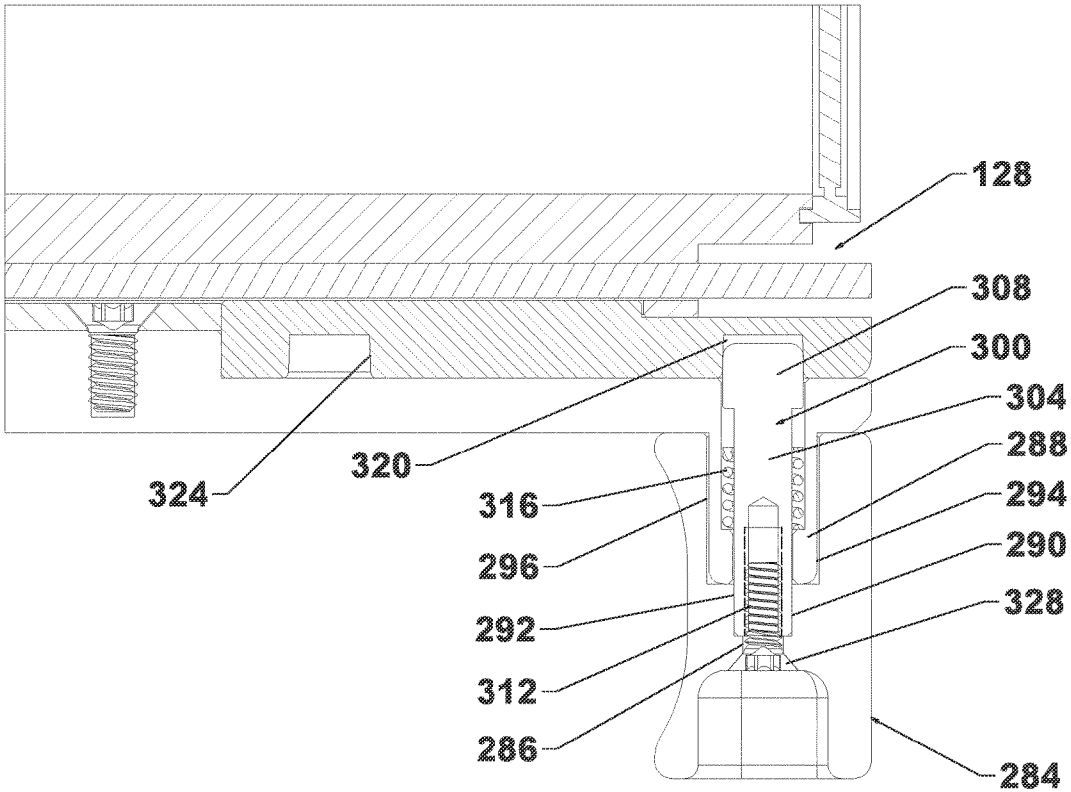
Figure 33:
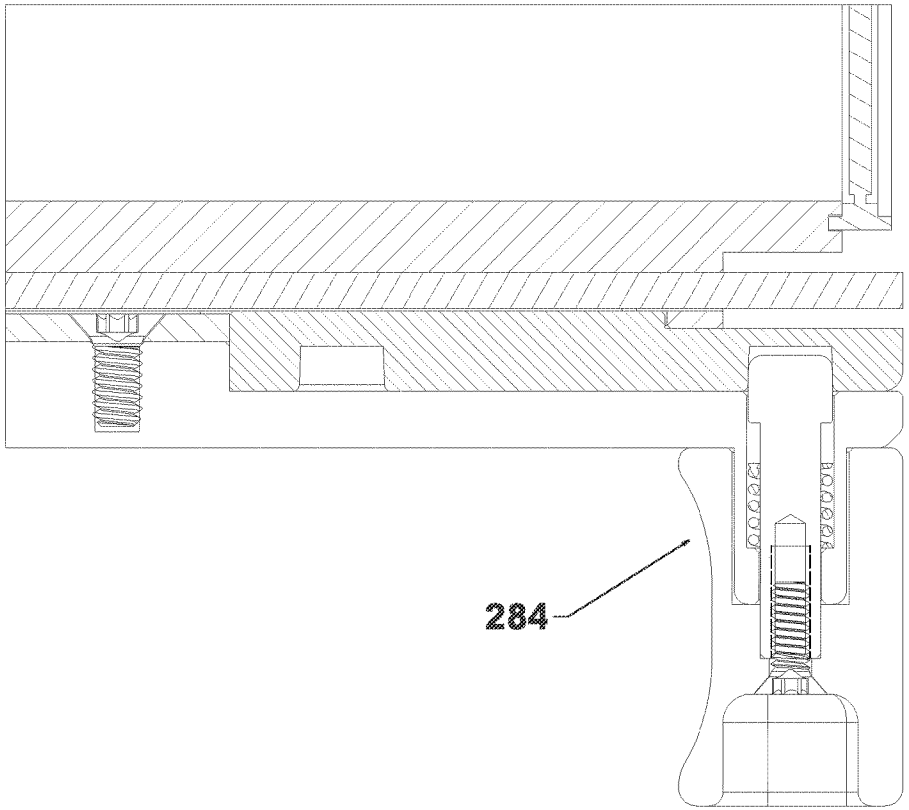

Referring now to the drawings, wherein like reference numeral refer to like components throughout the several views, combined launch/storage tube 100 according to the present disclosure includes a main housing 104 which defines a cavity 108. The cavity 108 forms a storage compartment for storing a missile 156 when the storage tube 100 is not attached to a firing platform and also serves as a barrel for firing the missile when the storage tube 100 is attached to a firing platform.

In the illustrated embodiment, the combined launch/storage tube 100 is configured for use in connection with the firing platform shown and described in the aforementioned publication no. US2016/0153744. It will be recognized, however, that the combined launch/storage tube herein may be adapted for use with other projectile weapon firing platforms.

The main housing 104 includes a front (muzzle) end 112 and a rear (breech) end 116. A threaded finish piece 120 is secured to the front end of the main housing 104. In certain embodiments, external helical threads 124 are formed on the threaded finish piece 120. A slot 128 is formed in the threaded finish piece 120 for slidably receiving a sliding safety tongue 180 as will be described in greater detail below.

An elastic disk 132 which may be formed of rubber, elastomer, or other flexible and resilient material is secured over the front opening of the main housing 104 to prevent or reduce entry of moisture or debris into the cavity 108. The elastic disk 132 includes a plurality of slots 136 slots defining a plurality of leaves or flaps 140 to define an exit opening for the missile 156. A front cover 144 includes a threaded annular sidewall or lip 148. In certain embodiments, the front cover has internal helical threads 152 which are complementary with the threads 124 on the front cover.

The missile 156 includes a firing cartridge 160 which may be, for example, a 40 mm shell casing or cartridge having a charge of explosive material to propel the missile 156 out of the launch tube 104. In rocket-boosted missile configurations, the charge of explosive material in the firing cartridge 160 may be relatively small since it is only necessary to launch the missile 156 a sufficient distance away from the operator to safely fire the rocket motor. In alternative embodiments, a rocket motor may be omitted and a larger charge of explosive material in the cartridge 160 for firing the missile may be used. The cartridge 160 may be ignited via an associated trigger mechanism or module (not shown), which may employ a mechanical firing pin or an electronic firing mechanism. In preferred embodiments, the associated firing mechanism or module may be as described in the aforementioned publication no. US2016/0153744. A circuit board 162 is received within the safety housing. The circuit board may be provided for programming a guidance or flight control computer or processor within the missile 156 in the tube 104, e.g., for guiding the missile 156 along a programmed fight path.

A safety assembly 164 includes a safety housing 168 secured to the bottom of the main housing 104. A safety housing cover 172 is secured over the safety housing 168 to form an axial channel 176. The safety tongue 180 is slidably received within the channel 176. A spring 184 includes a first end 188 which is fixed and a second end 190 urging the tongue in the forward direction.

In certain embodiments, a window 192 is formed in the safety housing cover 172 and indicia or colored regions may be formed on the sliding tongue 180 to provide a visual indication of when the missile is safe to fire. For example the tongue 180 may include a first portion or indicia 196 visible through the window 192 when the front cover 144 is attached, indicating that the missile is not safe to fire. The first indicia may be, for example, a color such as the color red. The tongue may also include a second portion or indicia 200 visible through the window 192 when the front cover 144 is removed, indicating that indicating that the missile is safe to fire. The second indicia may be, for example, a color such as the color green. It will be recognized that the first and second indicia may be other types of indicia, such as words, symbols, and so forth.

A rear cover assembly 204 includes an upper, axially extending portion 208 which extends from a rear wall portion 220. The portion 208 includes openings 216 removably receiving a rear cover retention pin 212. The retention pin 212 engages an annular channel 388 in a main boss 380 and may be secured in position within the openings 216 via a mechanical means, such as a spring loaded ball detent, cotter pin, or the like. A sealing ring or gasket 224 is disposed between the rearward opening of the main housing 104 and the rear wall portion 220.

The rear cover assembly 204 further includes a rear cover safety latch assembly 228. The rear cover safety latch assembly 228 includes a latch housing 232 which is secured to the rear cover via fastener 236. A pivot anchor 240 is secured to the latch housing via a fastener 244. Two opposing latch arms 248 are pivotally attached in latch pivot channels 256 in the pivot anchor 240 via latch pivot pins 252.

Each latch arm 248 includes latch hooks 260 disposed at a distal end thereof. Each latch arm includes a proximal end 264. The proximal ends of the opposing latch arms 248 are secured to a latch spring 268 which urges distal ends of the latch arms apart, and thereby urging the latch hooks 260 toward each other. Two latch plates or catches 272 are configured to selectively engage the respective latch hooks 260 and are disposed within safety housing 168.

When it is desired to use the unit 100 as a launch tube, the front cover 144 is first removed and the rear cover assembly 204 is then removed. When the front cover 144 is removed, the tongue 180 is urged in the forward direction by the spring 184, wherein the front end or tip 182 of the safety tongue 180 extends or protrudes from the safety housing 168 through the slot 128. Simultaneously, the rear end 276 of the tongue 180 is moved out from between the latch arms 248 to a position forward thereof, thereby allowing the latch spring 268 to urge the hooks 260 out of engagement with the respective latch plates 272. After the hooks 260 are moved out of engagement with the respective latch plates 272 and the rear cover retention pin 212 is removed, the rear cover assembly 204 can be removed from the main housing 104.

When it is desired to use the unit 100 as a storage tube, the rear cover assembly 204 is first attached to the device, followed by the front cover 144. When the front cover 144 is rotatably secured to the threads 124, the sidewall 148 advances in the rearward direction and the edge of the sidewall 148 urges the tongue 180 rearwardly, against the bias of the spring 184. The tongue 180 may have a rounded or tapered end 276 for engaging the latch arms 248 and urging the distal ends of the latch arms apart, against the bias of the spring 184, until the rear end of the tongue separates the latch arms and the latch hooks 260 engage the latch plates 272. The presence of the tongue 180 between the latch arms prevents the latch arm hooks from disengaging the latch plates.

A fastener plate 280 cooperates with a fastener element 336 on the rear cover to allow the user to secure the unit 100 a load bearing article such as a garment or rig of the type having grids of webbing, such as a tactical vest, nick sack, or the like. Such equipment may include MOLLE (Modular Lightweight Load-carrying Equipment) gear, ALICE (All-Purpose Lightweight Individual Carrying Equipment) gear, PALS (Pouch Attachment Ladder System) equipment, or the like.

The fastener plate 280 includes a handle 284 mounted to a handle boss 288 on the fastener plate 280. The handle boss 288 includes a bore 292 and a counter bore 296. A retractable pin 300 passes through the bore 292. The pin 300 includes a shaft 304, an enlarged diameter head 308, and an internally threaded axial opening 312 in the opposite end of the pin. A coil spring 316 is disposed within the counterbore 296 around shaft 304 and bears against the enlarged diameter head 308.

The handle 284 includes a bore 286 receiving a threaded fastener 328 recessed within a first counter bore 330 on a lower axial end of the handle 284 securing the handle 284 to the internally threaded end of pin, which protrudes through the bore 292 in the handle boss 296 and is received within a second counter bore 290 in the handle 284. The handle boss 284, in turn, is received within a third counterbore 294 in the handle 284. First and second recesses 320 and 324, respectively, are disposed in the safety housing cover and are axially spaced apart. Pulling on the handle 284 withdraws the pin 300 from the respective one of the recesses 320, 324 thereby allowing the user to slide the fastener plate 280 back and forth.

The fastener plate 280 includes a first MOLLE fastener tab 332 or the like and the second, stationary MOLLE fastener tab 336 or the like is disposed on rear cover. The fastener plate 280 includes a sliding rail 340 received within a channel 344 on the safety housing cover 172. A retention plate 348 is secured to the sliding rail 340 via threaded fasteners 350 to secure the sliding rail 340 within the channel 344. By using the handle 284 to alternately move the movable tab 332 away from and toward the fixed tab 336, the user can alternately attach and detach the unit 100 to a garment or equipment having MOLLE or like webbing grid.

A weapon interface is provided to attach the main housing 104 to a firing platform. In certain embodiments, the main housing 104 includes a mounting surface 352 on the upper surface thereof. A first dovetail channel 356 is formed in the surface 352 and receives a first complementary dovetail plate 360. The first dovetail plate 360 is secured within the first dovetail channel 356 with threaded fasteners 364. A second dovetail channel 368 is formed in the surface 352 and receives a second complementary dovetail plate 372. The second dovetail plate 372 is secured within the second dovetail channel 368 with threaded fasteners 376.

A main boss 380 is secured to the first dovetail plate 360 with threaded fasteners 384. The main boss 380 includes an annular channel 388. A second boss 392 is secured to the first dovetail plate 360 with threaded fasteners 396. A third boss 400 includes an upper flange 404 and is secured to the second dovetail plate 372 with threaded fasteners 408. A protrusion 412 is secured to the second dovetail plate 372 by threaded fasteners 414 to permit pivoting movement of the barrel unit 100 about the main boss 380 (e.g., for the purpose of loading a missile 156 into the breech end of cavity 108) in one direction only as described in the aforementioned publication no. US2016/0153744. Likewise, an opening 416 in the dovetail plate 372 removably receives a complementary engaging member to prevent pivoting movement of the unit 100 relative to the firing platform about the main boss 380 unless disengaged by the user. In this manner, the unit 100 may be interchanged with the grenade launch barrel modules publication no. US2016/0153744. It will be recognized, however, that in alternative embodiments, the dove tail interface plates 360, 372 can be exchanged with alternatively configured interface members to adapt the unit 100 to different firing platforms.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A dual purpose missile storage and launch tube device, comprising:

a tubular housing;

a front cover removably covering a first end of the tubular housing, the first end defining an opening for firing a missile;

a rear cover assembly removably covering a second end of the tubular housing, the second end opposite the first end;

a safety mechanism attached to the tubular housing, the safety mechanism including a sliding member extending through a longitudinal passageway formed in the safety mechanism;

wherein a forward portion of the sliding member engages the front cover;

wherein a rearward portion of the sliding member engages a first fastener locking the rear cover assembly onto the tubular housing when the front cover is attached to the first end of the tubular housing; and wherein the rearward portion of the sliding member is disengaged from the first fastener when the front cover is removed from the first end of the tubular housing for unlocking the rear cover assembly from the tubular housing.

2. The device of claim 1, further comprising:

a spring member disposed within the longitudinal passageway urging the sliding member toward the front cover.

3. The device of claim 1, wherein the front cover includes a closure wall and an annular lip that extends from the closure wall axially toward the second end, the annular lip having a threaded surface which mates with a complementary threaded surface on the first end for securing the front cover over the opening for firing a missile;

the annular lip having an edge which bears against the forward portion of the sliding member;

the threaded surface and the complementary threaded surface being movable into mating engagement with each other by threading upon relative rotation between the front cover and the tubular housing; and the rearward portion of the sliding member being moved into engagement with the first fastener upon axial movement of the front cover over the first end of the tubular housing.

4. The device of claim 1, further comprising an elastic disk disposed over the opening for firing a missile, the elastic disk having a plurality of slits defining a plurality of flaps.

5. The device of claim 1, further comprising the missile received within the tubular housing.

6. The device of claim 1, further comprising one or more indicia for visually indicating whether a missile contained within the tubular housing is safe to fire.

7. The device of claim 6, wherein the indicia includes a first indicia which is visible through a window in a wall defining the longitudinal passageway when the front cover is removed from the first end and which is not visible through the window when the front cover is attached to the first end.

8. The device of claim 1, wherein the first fastener includes a latch on the rear cover assembly removably engaging a catch on the safety mechanism.

9. The device of claim 1, further comprising a weapon interface attached to the tubular housing for removably attaching the device to a missile firing platform.

10. The device of claim 9, wherein the rear cover assembly is configured to cover the weapon interface when the rear cover assembly is covering the second end of the tubular housing.

11. The device of claim 10, further comprising a second fastener removably securing the rear cover assembly to the weapon interface.

12. The device of claim 1, further comprising a second fastener removably securing the rear cover assembly to the tubular housing.

13. The device of claim 1, further comprising a second fastener for securing the device to an article having a plurality of loops of webbing material, the second fastener comprising a first tongue attached to the rear cover assembly and a second tongue carried on a sliding member attached to the tubular hosing, the sliding member movable toward and away from the first tongue to selectively engage and disengage the plurality of loops of webbing material.

14. A method for assembling a dual purpose missile storage and launch tube device, the device comprising (a) a tubular housing; (b) a front cover configured to removably cover a first end of the tubular housing, the first end defining an opening for firing a missile; (c) a rear cover assembly configured to removably cover a second end of the tubular housing, the second end opposite the first end; and (d) a safety mechanism attached to the tubular housing, the safety mechanism including a sliding member extending through a longitudinal passageway formed in the safety mechanism; the method including the steps of:

attaching the rear cover to the second end of the tubular housing;

moving the sliding member into engagement with a fastener on the rear cover assembly by attaching the front cover to the first end of the tubular housing, the sliding member and the fastener cooperating to lock the rear cover into position over the second end.

15. The method of claim 14, wherein a force for moving the sliding member is transmitted by the front cover acting directly on the sliding member.

16. The method of claim 14, wherein the front cover includes a closure wall and an annular lip that extends from the closure wall axially toward the second end, the annular lip having a threaded surface which mates with a complementary threaded surface on the first end, the annular lip having an edge which bears against a forward portion of the sliding member.

17. The method of claim 16, wherein rotational movement of the front cover with respect to the tubular housing in one direction causes axial sliding movement of the sliding member.

18. The method of claim 14, wherein the fastener includes a latch on the rear cover assembly which removably engages a catch on the safety mechanism.

* * * * *